US011499411B2

(12) United States Patent
Agarwal et al.

(10) Patent No.: US 11,499,411 B2
(45) Date of Patent: Nov. 15, 2022

(54) METHODS, SYSTEMS, AND COMPUTER-READABLE MEDIA FOR PERFORMING AUTOMATED DRILLING OF A WELLBORE

(71) Applicant: Pason Systems Corp., Calgary (CA)

(72) Inventors: Kshitij Agarwal, Calgary (CA); Jonathan Alan McIntyre, Calgary (CA); Choon-Sun James Ng, Calgary (CA); Aaron Eddy, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 66 days.

(21) Appl. No.: 17/129,395

(22) Filed: Dec. 21, 2020

(65) Prior Publication Data

US 2022/0154571 A1 May 19, 2022

(30) Foreign Application Priority Data

Nov. 13, 2020 (CA) ..... CA 3099282

(51) Int. Cl.

*E21B 44/06* (2006.01)
*E21B 21/08* (2006.01)
*E21B 47/06* (2012.01)

(52) U.S. Cl.

CPC ..... *E21B 44/06* (2013.01); *E21B 21/08* (2013.01); *E21B 47/06* (2013.01)

(58) Field of Classification Search

CPC ..... E21B 21/08; E21B 44/00; E21B 44/06; E21B 47/06

See application file for complete search history.

(56) References Cited

U.S. PATENT DOCUMENTS 6,050,348 A 4/2000 Richarson et al.
6,918,453 B2 7/2005 Haci et al.
(Continued)

FOREIGN PATENT DOCUMENTS

CA 2525382 A1 11/2004
CA 2525371 A1 12/2004
(Continued)

OTHER PUBLICATIONS

Shell International Exploration and Production B.V.; "Well Engineers Notebook" Feb. 1998; 4th Edition, May 2003.
(Continued)

*Primary Examiner* — Brad Harcourt
(74) *Attorney, Agent, or Firm* — D'Ambrosio & Menon, PLLC; Usha Menon

(57) ABSTRACT

There is described a computer-implemented method of controlling a drilling operation. In particular, there is described a computer-implemented method of determining that a differential pressure is in an oscillating state. In response to determining that the differential pressure is in the oscillating state, a weight on bit setpoint is decreased so as to decrease the differential pressure. There is also described a computer-implemented method of determining a difference between a differential pressure and a target differential pressure. The target differential pressure is less than a differential pressure limit. A weight on bit setpoint is adjusted as a function of the difference between the differential pressure and the target differential pressure so as to adjust the differential pressure and thereby reduce the difference between the differential pressure and the target differential pressure.

20 Claims, 19 Drawing Sheets

(56) References Cited

U.S. PATENT DOCUMENTS

| | | | | |
|---|---|---|---|---|
| 7,096,979 | B2 | 8/2006 | Haci et al. | |
| 7,152,696 | B2 | 12/2006 | Jones | |
| 7,588,099 | B2 | 9/2009 | Kracik | |
| 7,823,655 | B2 | 11/2010 | Boone et al. | |
| 10,036,678 | B2 | 7/2018 | Fisher, Jr. et al. | |
| 10,190,402 | B2 | 1/2019 | Dykstra et al. | |
| 2002/0104685 | A1 | 8/2002 | Pinckard et al. | |
| 2018/0119537 | A1* | 5/2018 | Viens | E21B 19/16 |
| 2018/0135402 | A1* | 5/2018 | Jeffryes | E21B 44/06 |
| 2020/0157930 | A1* | 5/2020 | Jeffryes | E21B 21/08 |
| 2020/0270978 | A1* | 8/2020 | Dobkins | E21B 44/06 |

FOREIGN PATENT DOCUMENTS

| | | | |
|---|---|---|---|
| CA | 2582365 | A1 | 4/2006 |
| CA | 2636249 | A1 | 8/2007 |
| CA | 2700258 | A1 | 3/2009 |
| CA | 2921163 | A1 | 4/2015 |
| CA | 2938521 | A1 | 9/2015 |

OTHER PUBLICATIONS

Guangzhi Han et al; "Practical Directional Drilling Techniques in Pinedale Field Wyoming to Improve Drilling Performance" Nov. 2013.

* cited by examiner

| | | |
|---|---|---|
| Historical Aug 21-Aug 21, 2019 (1 hr 25 mins 50 secs) | DAS ROP ft/hr | DAS WOB Upper Limit klbs |
| | On Bottom ROP ft/hr | AutoDriller WOB SP klbs |
| | AutoDriller Status | Weight on Bit klbs |
| | Wave WOB Correlation | Differential Pressure psi |
| Hole Depth ft | AutoDriller On Bottom ROP Setpoint ft/hr | AutoDriller Diff Press SP psi |
| Bit Depth ft | DAS in Control | Wave SP Tracking Status |

METHODS, SYSTEMS, AND COMPUTER-READABLE MEDIA FOR PERFORMING AUTOMATED DRILLING OF A WELLBORE

CROSS REFERENCE TO RELATED APPLICATION(S)

This application is related to and claims priority to Canadian Patent Application No.: 3099282 filed on Nov. 13, 2020, the contents of which are incorporated by reference herein

TECHNICAL FIELD

The present disclosure is directed at methods, systems, and computer-readable media for performing automated drilling of a wellbore.

BACKGROUND

Oil and gas wellbore drilling may be partially or entirely automated. For example, certain example automated drilling units (or "AutoDrillers") may attempt to maximize rate of penetration by varying weight on bit in response to one or more measured drilling parameters. Examples of those drilling parameters may comprise any one or more of readings from hookload, depth, and drilling fluid pressure sensors. Those units are designed to increase drilling efficiency by, for example, extending drill bit life and reducing total drilling hours.

Differential pressure is a measurement of fluid force per unit area subtracted from a higher measurement of fluid force per unit area. This comparison can be made between pressures outside and inside a pipe. Differential pressure is commonly calculated as the current standpipe pressure relative to a reference point, $\Delta DP = SPP - P_{ref}$.

Differential pressure is used when mud motors are used. Mud motors are devices that convert hydraulic power, generated by the circulation of drilling fluid from the surface and down through the drill pipe, to mechanical (rotational) power directly at the drill bit. A mud motor is used to increase the bit rotational speed above that which is achievable through rotation at the surface alone, and also whenever it is necessary to rotate the drill bit without rotating the drill string. Drilling fluid is pumped with the bit off the bottom at the rate to be used while drilling. An initial standpipe pressure measurement is made and is used as a reference point ("zero pressure", $P_{ref}$). When the drill bit is lowered to the bottom and cuts into the rock, the pressure increases and the difference relative to the reference point is the differential pressure, DP. It is the pressure across the mud motor and is an indication of the torque applied to the drill bit.

Differential pressure is often used as a control parameter during drilling operations. Limits on differential pressure are typically prescribed to prevent excessive strain on downhole equipment, such as mud motors, which can lead to premature wear and failure, as well as events such as mud motor stalls. The prescribed limit is typically dependent on equipment manufacturer specifications, risk tolerances, and best practices. For example, a differential pressure setpoint may be set to 80% of the Maximum Differential Pressure, DPmax, rating of the mud motor. In other cases, the differential pressure setpoint may be lowered to account for variability in the differential pressure signal to prevent unexpected surges from exceeding a differential pressure limit. The limits are usually enforced by setting an AutoDriller setpoint, and/or other limits such as on standpipe pressure, as well as output levels on pump controllers.

During on-bottom rotary drilling operations, it is desirable to maintain drilling parameters at a prescribed level, or within a desired range. AutoDrillers are typically used to enforce constraints on drilling parameters, such as Rate of Penetration (ROP), Weight On Bit (WOB), Rotary RPM (RPM), Rotary Torque (TQ), and Differential Pressure (DP). The dependence of each drilling parameter on each other drilling parameter is not precisely known. AutoDrillers must simultaneously manage each of the drilling parameters such that all prescribed limits are enforced. This is typically accomplished by controlling a drawworks subsystem which in turn controls the rate at which the drill pipe is lowered into the borehole. Increasing the rate of release typically results in an increase in downhole weight on bit, and subsequently the measured surface weight on bit. A corresponding increase in differential pressure measured at the surface is expected as a proxy for the increase in torque on the drill bit due to the elevated downhole weight on bit.

Differential pressure may vary significantly and unexpectedly throughout the drilling process due to, for example, geologic heterogeneity, and it is often difficult to design and tune AutoDrillers to manage differential pressure in all situations.

SUMMARY

According to a first aspect of the disclosure, there is provided a computer-implemented method of controlling a drilling operation, comprising: determining that a differential pressure is in an oscillating state, comprising determining that the differential pressure has exceeded a differential pressure limit at least a preset number of times during a preset time window; and in response to determining that the differential pressure is in the oscillating state, decreasing a weight on bit setpoint so as to decrease the differential pressure.

The computer-implemented method may further comprise: determining that at least a first time the differential pressure exceeded the differential pressure limit occurred outside the preset time window; and ignoring the at least the first time the differential pressure exceeded the differential pressure limit when determining whether the differential pressure is in the oscillating state.

The preset time window may be a rolling time window.

Determining that the differential pressure is in the oscillating state may further comprise determining whether an average magnitude of the differential pressure since a first time the differential pressure exceeded the differential pressure limit, or since a beginning of the preset time window, is greater than a threshold.

The computer-implemented method may further comprise: determining that the average magnitude of the differential pressure is not greater than the threshold; and in response to determining that the average magnitude of the differential pressure is not greater than the threshold, ignoring the first time the differential pressure exceeded the differential pressure limit when determining whether the differential pressure is in the oscillating state.

Determining that the differential pressure is in the oscillating state may further comprise determining whether an average magnitude of a weight on bit since a first time the differential pressure exceeded the differential pressure limit, or since a beginning of the preset time window, is greater than a threshold.

The computer-implemented method may further comprise: determining that the average magnitude of the weight on bit is not greater than the threshold; and in response to determining that the average magnitude of the weight on bit is not greater than the threshold, ignoring the first time the differential pressure exceeded the differential pressure limit when determining whether the differential pressure is in the oscillating state.

Determining that the differential pressure is in the oscillating state may further comprise: determining whether an average difference between a weight on bit and the weight on bit setpoint, since a first time the differential pressure exceeded the differential pressure limit, or since a beginning of the preset time window, is greater than a threshold.

The computer-implemented method may further comprise: determining that the average difference between the weight on bit and the weight on bit setpoint is greater than the threshold; and in response to determining that the average difference between the weight on bit and the weight on bit setpoint is greater than the threshold, ignoring the first time the differential pressure exceeded the differential pressure limit when determining whether the differential pressure is in the oscillating state.

Determining that the differential pressure is in the oscillating state may further comprise: determining that an average magnitude of the differential pressure, since a first time the differential pressure exceeded the differential pressure limit, or since a beginning of the preset time window, is greater than a first threshold; and determining that an average magnitude of a weight on bit, since the first time the differential pressure exceeded the differential pressure limit, or since the beginning of the preset time window, is greater than a second threshold; and determining that an average difference between the weight on bit and the weight on bit setpoint, since the first time the differential pressure exceeded the differential pressure limit, or since the beginning of the preset time window, is greater than a third threshold.

The preset number of times may be three times.

According to a further aspect of the disclosure, there is provided a computer-implemented method of controlling a drilling operation, comprising: determining a difference between a differential pressure and a target differential pressure, wherein the target differential pressure is less than a differential pressure limit; and adjusting a weight on bit setpoint as a function of the difference between the differential pressure and the target differential pressure so as to adjust the differential pressure and thereby reduce the difference between the differential pressure and the target differential pressure.

Adjusting the weight on bit setpoint may comprise: determining a relationship between a weight on bit and the differential pressure; and adjusting the weight on bit setpoint based on the relationship.

Determining the relationship may comprise: obtaining a dataset comprising weight on bit measurements as a function of differential pressure measurements; and performing statistical analysis on the dataset.

Performing the statistical analysis may comprise performing linear regression.

The computer-implemented may further comprise, prior to adjusting the weight on bit setpoint, determining whether a slope of the output of the linear regression is within a preset range of slopes.

The computer-implemented method may further comprise: determining a lag between the weight on bit measurements and the differential pressure measurements; and adjusting the dataset based on the lag.

Adjusting the weight on bit setpoint based on the relationship may comprise: determining a target weight on bit based on the relationship; determining an adjustment to be made to the weight on bit setpoint based on the target weight on bit; and adjusting the weight on bit setpoint based on the determined adjustment.

Determining the adjustment to be made to the weight on bit setpoint may comprise determining (target WOB−current WOB)*dpmax.gain, wherein target WOB is the target weight on bit setpoint, current WOB is the weight on bit setpoint, and dpmax.gain is a constant.

The computer-implemented method may further comprise, prior to adjusting the weight on bit setpoint, determining whether the differential pressure is greater than a differential pressure setpoint.

The target differential pressure may be based on one or more specifications of a mud motor.

The computer-implemented method may further comprise, prior to adjusting the weight on bit setpoint, determining whether adjusting the weight on bit setpoint is in compliance with one or more of: a stick slip protocol; a Rotating Control Device (RCD) handling protocol; a limiting protocol; and a stringer handling protocol. A limiting protocol may be a protocol that determines whether a drilling parameter such as differential pressure, torque, or rate of penetration is too close to or beyond an associated limit.

The target differential pressure may comprise a range of differential pressures.

The computer-implemented method may further comprise: determining, based on the range of differential pressures, one or more ranges of one or more drilling parameter setpoints, wherein the one or more drilling parameter setpoints are used as one or more inputs to a feedback control loop and are adjusted based on one or more outputs of the feedback control loop; and constraining adjustments to the one or more drilling parameter setpoints based on the determined one or more ranges of the one or more drilling parameter setpoints.

The one or more drilling parameter setpoints may comprise one or more of: the weight on bit setpoint, a rotary RPM setpoint; and a downhole RPM setpoint.

According to a further aspect of the disclosure, there is provided a computer-implemented method of controlling a drilling operation, comprising: determining a relationship between a weight on bit and a differential pressure; determining, based on the relationship and based on a target differential pressure range, a target weight on bit range, wherein the target differential pressure range is less than a differential pressure limit; and adjusting, based on the target weight on bit range, a weight on bit setpoint so as to adjust the differential pressure and thereby maintain the differential pressure within the target differential pressure range.

The computer-implemented method may further comprise determining whether the target weight on bit range is compliant with one or more existing weight on bit setpoint limits.

The computer-implemented method may further comprise: determining that the target weight on bit range is not compliant with the one or more existing weight on bit setpoint limits; and in response determining that the target weight on bit range is not compliant with the one or more existing weight on bit setpoint limits, adjusting the target weight on bit range so that the target weight on bit range is compliant with the one or more existing weight on bit setpoint limits.

Determining the relationship may comprise: obtaining a dataset comprising weight on bit measurements as a function of differential pressure measurements; and performing statistical analysis on the dataset.

Performing the statistical analysis may comprise performing linear regression.

Adjusting the weight on bit setpoint may comprise determining whether the weight on bit setpoint is outside of the target weight on bit range by at least a minimum threshold.

Adjusting the weight on bit setpoint may further comprise: determining that the weight on bit setpoint is outside of the target weight on bit range by at least the minimum threshold; determining a difference between the weight on bit setpoint and a further minimum threshold; and adjusting the weight on bit setpoint based on the difference.

The target differential pressure range may be based on one or more specifications of a mud motor.

The computer-implemented method may further comprise, prior to adjusting the weight on bit setpoint, determining whether adjusting the weight on bit setpoint would cause one or more of a torque limit, the differential pressure limit, a standpipe pressure limit, and a rate of penetration limit to be exceeded.

According to a further aspect of the disclosure, there is provided a computer-readable medium having computer program code stored thereon and configured when executed by one or more processors to cause the one or more processors to perform any of the above-described methods for controlling a drilling operation.

According to a further aspect of the disclosure, there is provided a system comprising: a drill string comprising a bottom hole assembly including a drill bit; a drawworks operable to control a weight applied to the drill bit; and an oscillation detector comprising computer-readable memory and one or more processors, wherein the compute-readable memory comprises computer program code stored thereon and configured, when executed by the one or more processors, to cause the one or more processors to perform any of the above-described methods of controlling a drilling operation.

BRIEF DESCRIPTION OF THE DRAWINGS

In the accompanying drawings, which illustrate one or more example embodiments.

DETAILED DESCRIPTION

Figure 1:
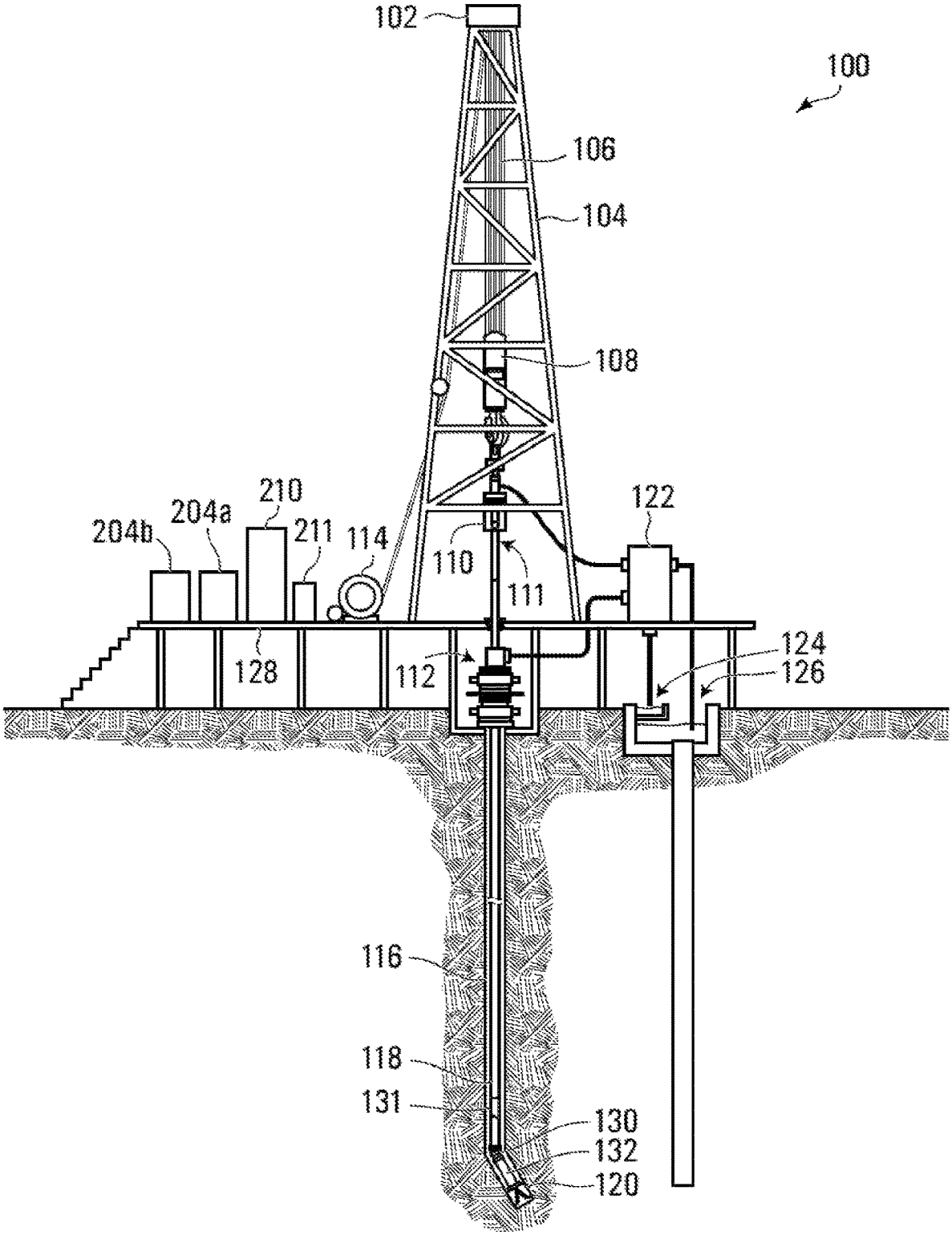
FIG. 1 is a schematic of a drilling rig, according to an embodiment of the disclosure.

The present disclosure seeks to provide methods, systems, and computer-readable media for performing automated drilling of a wellbore. While various embodiments of the disclosure are described below, the disclosure is not limited to these embodiments, and variations of these embodiments may well fall within the scope of the disclosure which is to be limited only by the appended claims.

The embodiments described herein are generally directed at controlling differential pressure by controlling one or more setpoints of other drilling parameters. According to embodiments of the disclosure, there is described a method of detecting that differential pressure is in an oscillating state. For example, the method includes determining that differential pressure has exceeded a differential pressure limit at least a preset number of times during a preset time window. For example, the method may include determining that differential pressure has exceeded a differential pressure limit at least three times during a maximum time window, such as 370 seconds. Oscillations in differential pressure typically coincide with oscillations in other drilling parameters such as weight on bit, rate of penetration, and torque. Therefore, in addition to detecting oscillations in differential pressure, the method may include detecting that weight on bit oscillations have occurred, and may further include detecting that a loss in setpoint tracking has occurred (e.g. if a difference between weight on bit and a weight on bit setpoint is greater than a preset threshold). In response to these additional determinations, the method may include determining that differential pressure is in an oscillating state. In response to determining that differential pressure is in an oscillating state, a weight on bit setpoint is decreased. Generally, decreasing the WOB setpoint will result in the average differential pressure decreasing, will mitigate the oscillating state of differential pressure, and will reduce the likelihood of the differential pressure exceeding its upper limit and returning to an oscillating state.

In addition to adjusting weight on bit so as to avoid differential pressure entering an oscillating state, embodiments described herein are also directed at maintaining differential pressure at or close to a target differential pressure, or within a target differential pressure range. The target differential pressure and the target differential pressure range correspond respectively to an efficient operating target and an efficient operating target range of the mud motor being used, or respectively to a target and a target range that prevent or mitigate a risk of damage to equipment including the mud motor. Therefore, it is generally preferable for differential pressure to be maintained at or close to a target differential pressure, or within a target differential pressure range.

Therefore, according to embodiments of the disclosure, there is described a method of determining a difference between a differential pressure and a target differential pressure. The target differential pressure is less than a differential pressure limit, but for example may be optimum preferred differential pressure at which to drill based on one or more specifications of the mud motor. The method includes adjusting a weight on bit setpoint as a function of the difference between the differential pressure and the target differential pressure. For example, a linear regression of weight on bit data and differential pressure data may be performed to determine a target weight on bit. The weight on bit setpoint may then be adjusted based on the target weight on bit. This will result in the differential pressure being adjusted toward the target differential pressure. Thus, drilling may be made more efficient and/or a risk of damage to equipment, including the mud motor, may be mitigated.

In addition, according to the embodiments of the disclosure, there is a described a method comprising determining a relationship between a differential pressure and an associated weight on bit. For example, a regression of weight on bit data and differential pressure data may be performed to determine a model of the relationship between differential pressure and weight on bit. The model may then be used to estimate the target weight on bit range corresponding to the target differential pressure range. Based on the determined relationship, and based on a target differential pressure range, a corresponding weight on bit range may be estimated. An upper limit of the target differential pressure range may be less than a differential pressure limit. An upper limit of the weight on bit range may correspond to the upper limit of the target differential pressure range, and may be less than an upper limit on weight on bit. A lower limit of the weight on bit range may correspond to a lower limit of the target differential pressure range, and may be greater than a lower limit on the weight on bit. The method may include adjusting a weight on bit setpoint if the weight on bit setpoint is determined to be outside of the target weight on bit range. Thus, as a result of the adjustment to the weight on bit setpoint, the differential pressure may be maintained within the target differential pressure range.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change WOB during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Figure 2A:
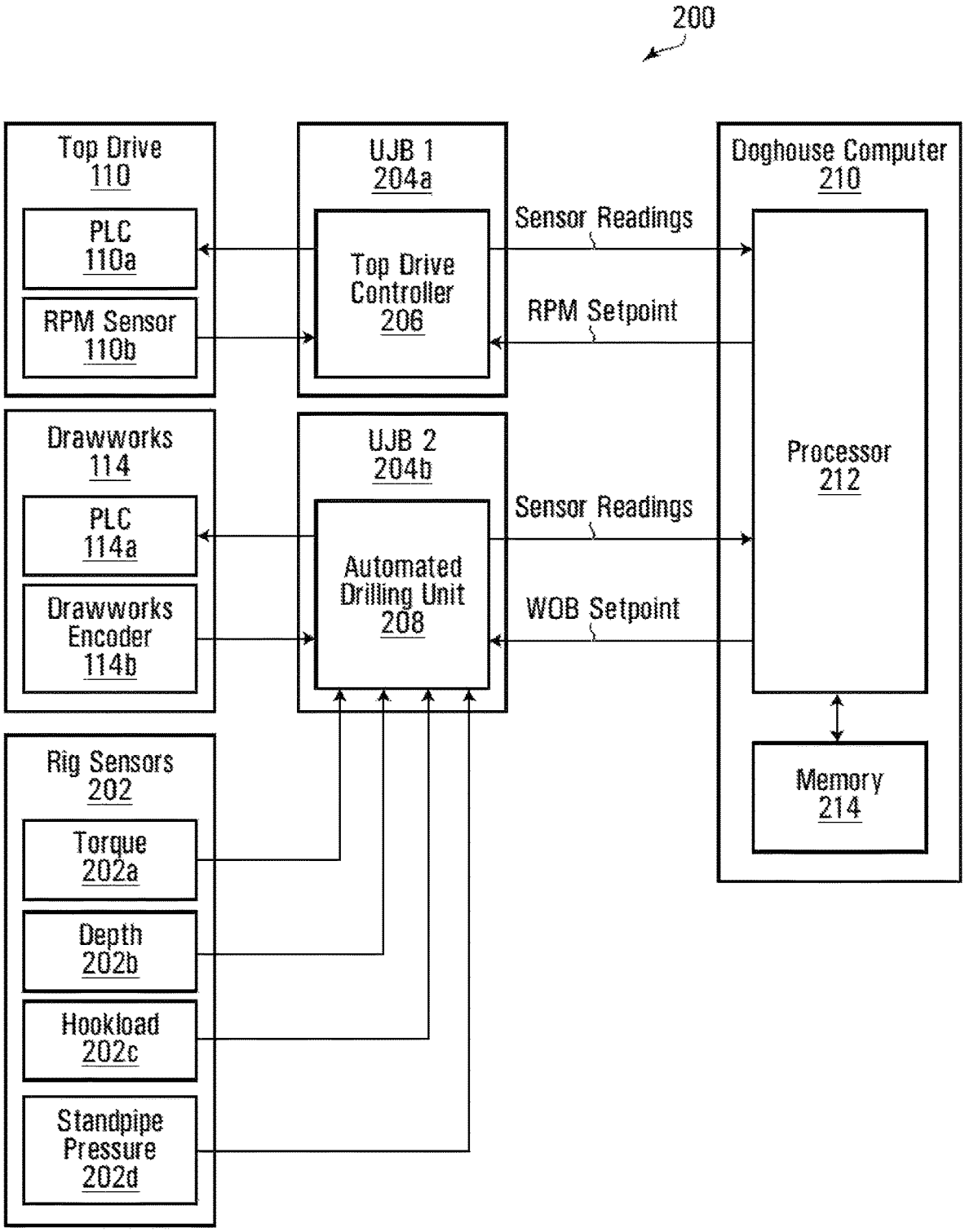
FIGS. 2A and 2B are block diagrams of systems for performing automated drilling of a wellbore, according to the embodiment of FIG. 1.

FIG. 2A shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206, which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208, which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the ROP of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores on it computer program code that is executable by the processor 212 and that, when executed, causes the processor 212 to perform a method 500 for performing automated drilling of the wellbore 116, such as that depicted in FIG. 5. The processor 212 receives readings from the RPM sensor 110*b*, drawworks encoder 114*b*, and the rig sensors 202, and sends an RPM target and a WOB target to the top drive controller 206 and automated drilling unit 208, respectively. The top drive controller 206 and automated drilling unit 208 relay these targets to the top drive PLC 110*a* and drawworks PLC 114*a*, respectively, where they are used for automated drilling. More generally, the RPM target is an example of a rotation rate target.

Each of the first and second junction boxes may comprise a Pason Universal Junction Box™ (UJB) manufactured by Pason Systems Corp. of Calgary, Alberta. The automated drilling unit 208 may be a Pason AutoDriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2A, the top drive controller 110 and the automated drilling unit 208 are distinct and respectively use the RPM target and WOB target for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM target, only the WOB target, one or both of the RPM and WOB targets in combination with additional drilling parameters, or targets based on drilling parameters other than RPM and WOB. Examples of these additional drilling parameters comprise differential pressure, an ROP target, depth of cut, torque, and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 2B:
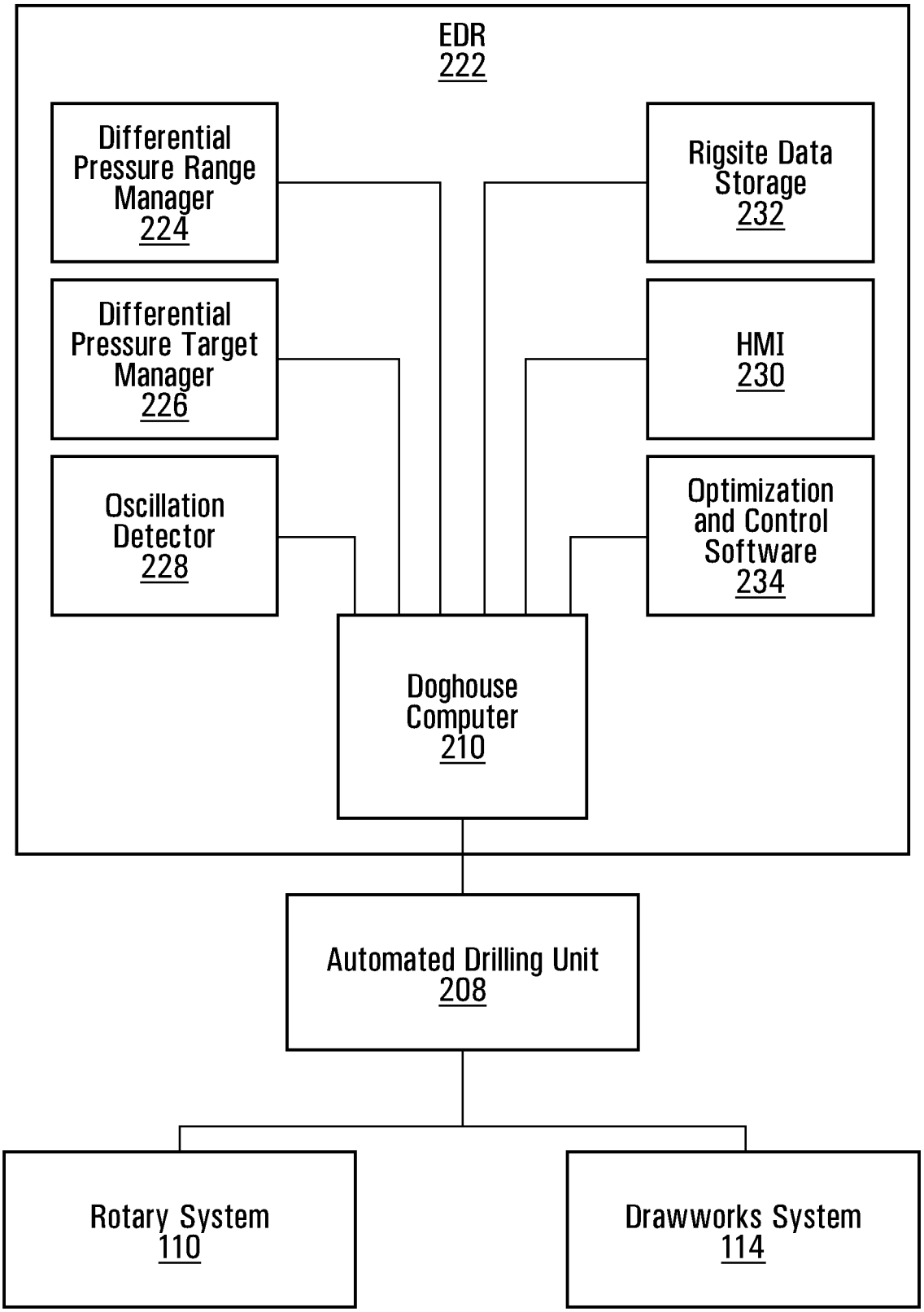

Turning to FIG. 2B, there is shown a block diagram of a system 220 for performing target differential pressure range management, target differential pressure management, and differential pressure oscillation detection. Within the context of the present disclosure, target differential pressure range management may refer to a process in which weight on bit is controlled to a target weight on bit range corresponding to a target differential pressure range, so that differential pressure is controlled to the target differential pressure range, as described in further detail below. Within the context of the present disclosure, differential pressure target management may refer to a process in which weight on bit is controlled to a target weight on bit, so that differential pressure is controlled to a target differential pressure that is less than a differential pressure limit. Within the context of the present disclosure, oscillation detection may refer to a process in which fluctuations in differential pressure and other drilling parameters are detected, as described in further detail below. System 220 includes an Electronic Drilling Recorder (EDR) 222 comprising a target differential pressure range manager 224 for performing target differential pressure range management, a target differential pressure manager 226 for performing target differential pressure management, an oscillation detector 228 for performing differential pressure oscillation detection, a Human Machine Interface (HMI) 230, rigsite data storage 232, optimization and control software 234, and doghouse computer 210.

Doghouse computer 210 collects sensor readings from UJB 204*b* (FIG. 2A). The sensor readings (which may be referred to as drilling parameters) include RPM, WOB, differential pressure, torque, travelling block height (or simply "block height"), and depth, and may be derived directly from the measurements obtained by the sensors. Other drilling parameters may be derived from RPM, WOB, differential pressure, and torque. For example, bit torque may be derived from differential pressure times the ratio of a maximum torque of mud motor 132 to a maximum differential pressure of mud motor 132. Doghouse computer 210 processes the sensor readings into a stream of sensor data, and target differential pressure range manager 224, target differential pressure manager 226, and oscillation detector 228 are configured to receive the sensor data from doghouse computer 210. Based on the sensor data, target differential pressure range manager 224, target differential pressure manager 226, and oscillation detector 228 may adjust one or more drilling parameter setpoints, such as a WOB setpoint. Each of the target differential pressure range manager 224, target differential pressure manager 226, and oscillation detector 228 may operate in parallel, tandem, or independently of each other, in addition to other functions such as optimization processes and routines that handle other aspects of the drilling process, such as managing stick slip.

Target differential pressure range manager 224, target differential pressure manager 226, and oscillation detector 228 may furthermore prevent further adjustment of one or more drilling parameters, such as the WOB setpoint, by restricting the one or more setpoints according to one or more objectives of target differential pressure range manager 224, target differential pressure manager 226, and oscillation detector 228. The setpoints prescribed by target differential pressure range manager 224, target differential pressure manager 226, and oscillation detector 228 may in turn be restricted by each other, or by additional functions such as optimization processes and routines that handle other aspects of the drilling process, such as the management of stick slip.

Adjusted drilling parameter setpoints are communicated to doghouse computer 210 and are sent from doghouse computer 210 to automated drilling unit 208. Automated drilling unit 208 may then control the drilling operation based on the updated drilling parameter setpoints, by controlling a rotary system (e.g., top drive 110) and a drawworks system (e.g., drawworks 114).

Figure 3:
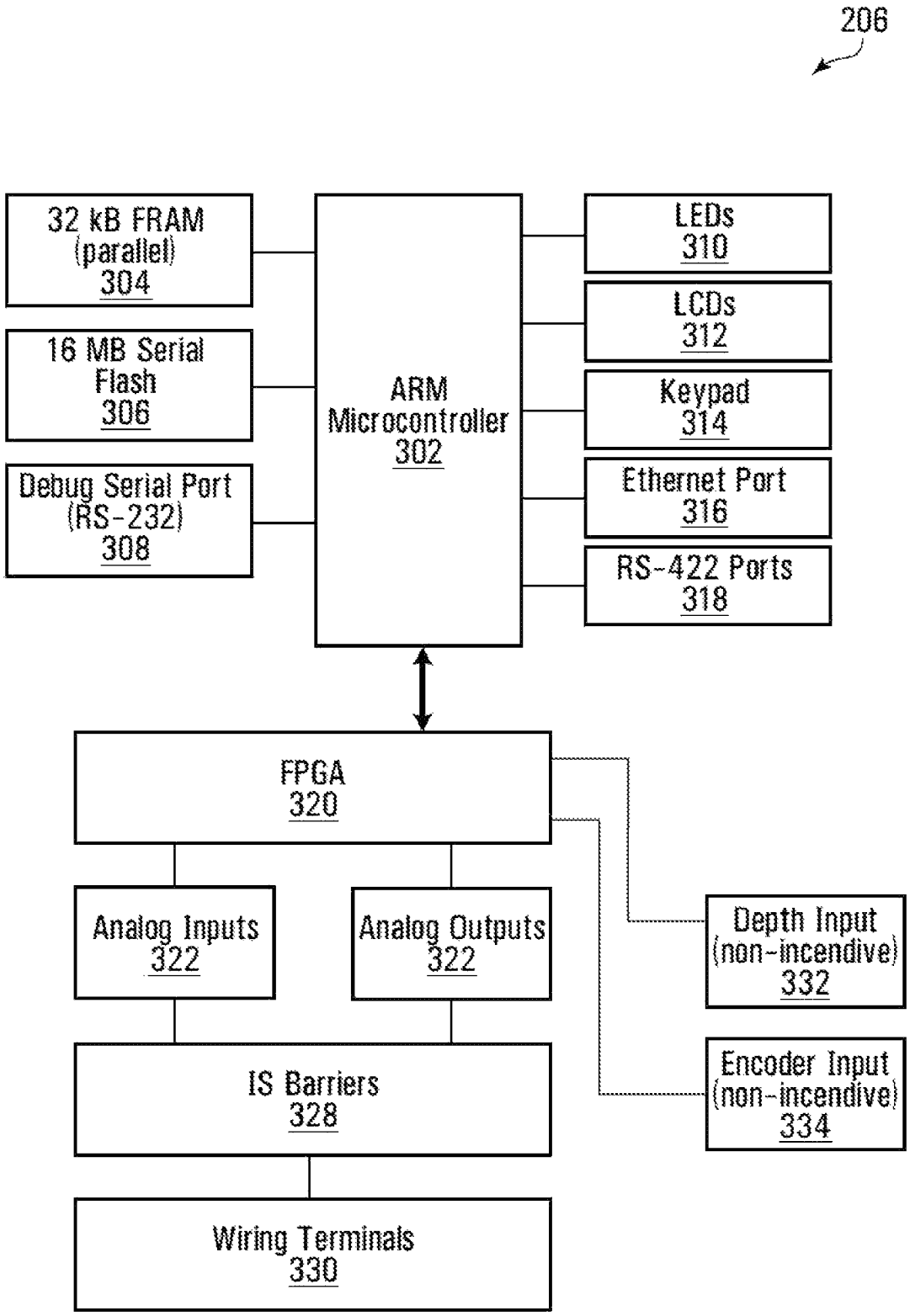
FIG. 3 depicts a block diagram of the automated drilling unit of FIG. 1, according to an embodiment of the disclosure.

Referring now to FIG. 3, there is shown a hardware block diagram 300 of the second junction box 204*b* of FIG. 2A. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automated drilling unit 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automated drilling unit 208 outputs a throttle signal to a PLC using an analog output. According to some embodiments, automated drilling unit 208 communicates with a band brake controller using an RS-422 port.

The FPGA 320 is also communicatively coupled to a non-incendive depth input 332 and a non-incendive encoder input 334. In different embodiments (not depicted), the automated drilling unit 208 may receive different sensor readings in addition to or as an alternative to the readings obtained using the depicted sensors 202*a*,202*b*,202*c*,202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
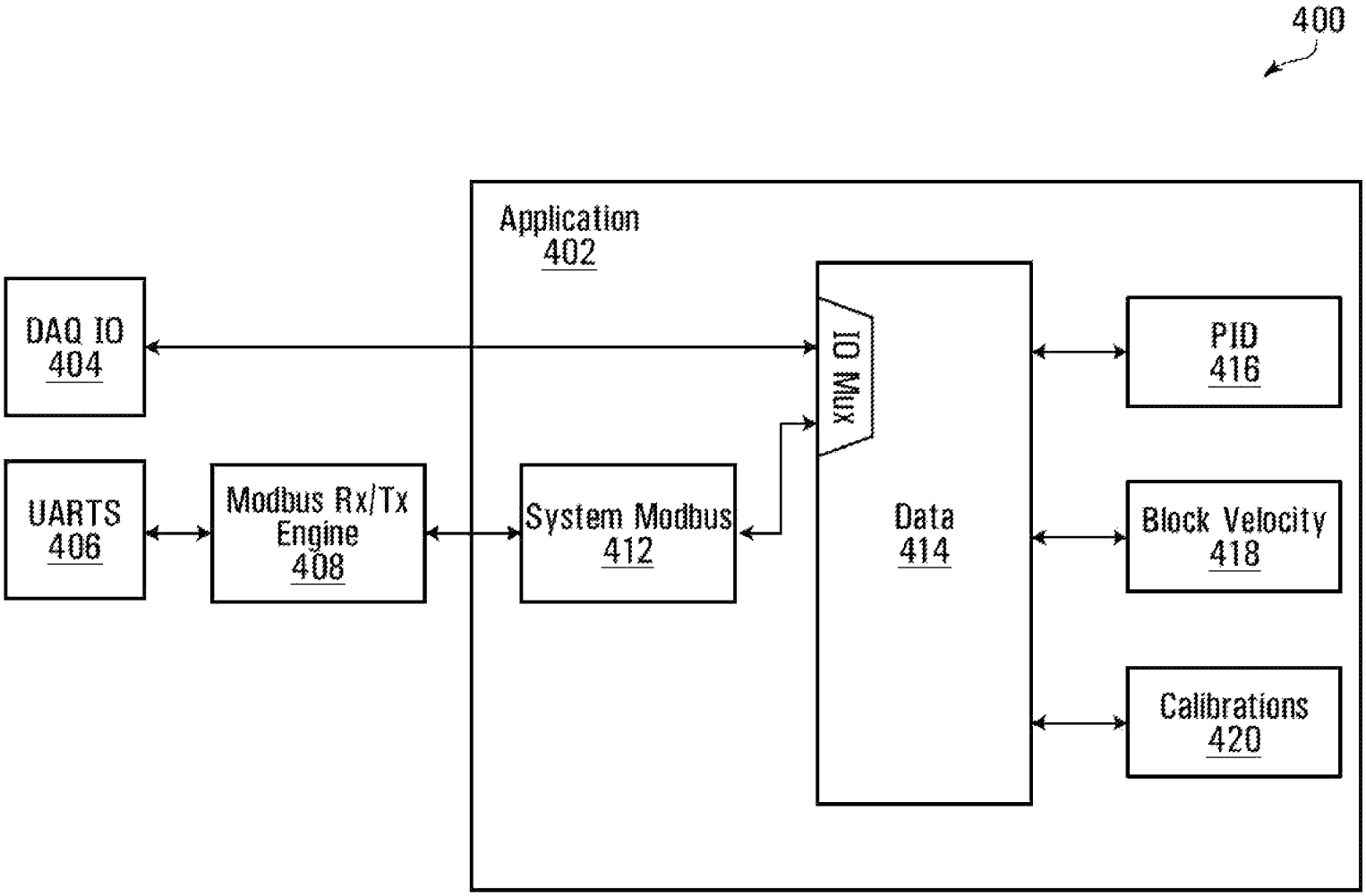
FIG. 4 depicts a block diagram of software modules running on the automated drilling unit of FIG. 1, according to an embodiment of the disclosure.

Referring now to FIG. 4, there is shown a block diagram of software modules, some of which comprise a software application 402, running on the automated drilling unit of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the traveling block 108 from the traveling block height derived using measurements from the block height sensor. The microcontroller 302 uses the calibrations module 420 to convert the electrical signals received from the sensors 202*a*,202*b*,202*c*,202*d* into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

As mentioned above, the relationships between measured surface weight on bit, actual downhole weight on bit, torque on the drill bit, and differential pressure can be variable throughout the drilling of a wellbore, and generally may not be directly measured. The variability arises from changes in, for example, geology which can result in small and large unexpected fluctuations in differential pressure. In some cases, the fluctuations in differential pressure can temporarily cause differential pressure to exceed the differential pressure limit assigned to the AutoDriller. In response, the AutoDriller will attempt to bring differential pressure back below the limit by decreasing the rate of release of the drill pipe to reduce weight on bit, and subsequently differential pressure.

This method of managing differential pressure to enforce the prescribed limits is challenging due to, for example, the aforementioned unexpected changes in drilling conditions, setpoint changes resulting in infeasible parameter levels, ill-prescribed limits resulting in conflicting control objectives, sub-optimal tuning of AutoDriller control loops, and also due to time delays between the responses of each drilling parameter and the AutoDriller inputs. Each of these factors can contribute to undesirable behavior of the AutoDriller control system, such as large swings and oscillatory behavior of the rate of release, which then can propagates to other drilling parameters and corresponding control loops, such as rate of penetration, weight on bit, torque, and differential pressure. For example, in AutoDrillers based on PID (Proportional Integral Derivative) control, over compensation due to aggressive tuning can result in integral windup, resulting in poor controller behavior. Large changes in any one of the control parameters can also lead to poor drilling performance, such as temporary or prolonged decreases in the rate of drilling, as well as potentially destructive drilling dysfunctions such as bit bounce, whirl, stick slip, motor stalls, and shocks which can cause premature wear and failure of equipment.

Figure 5:
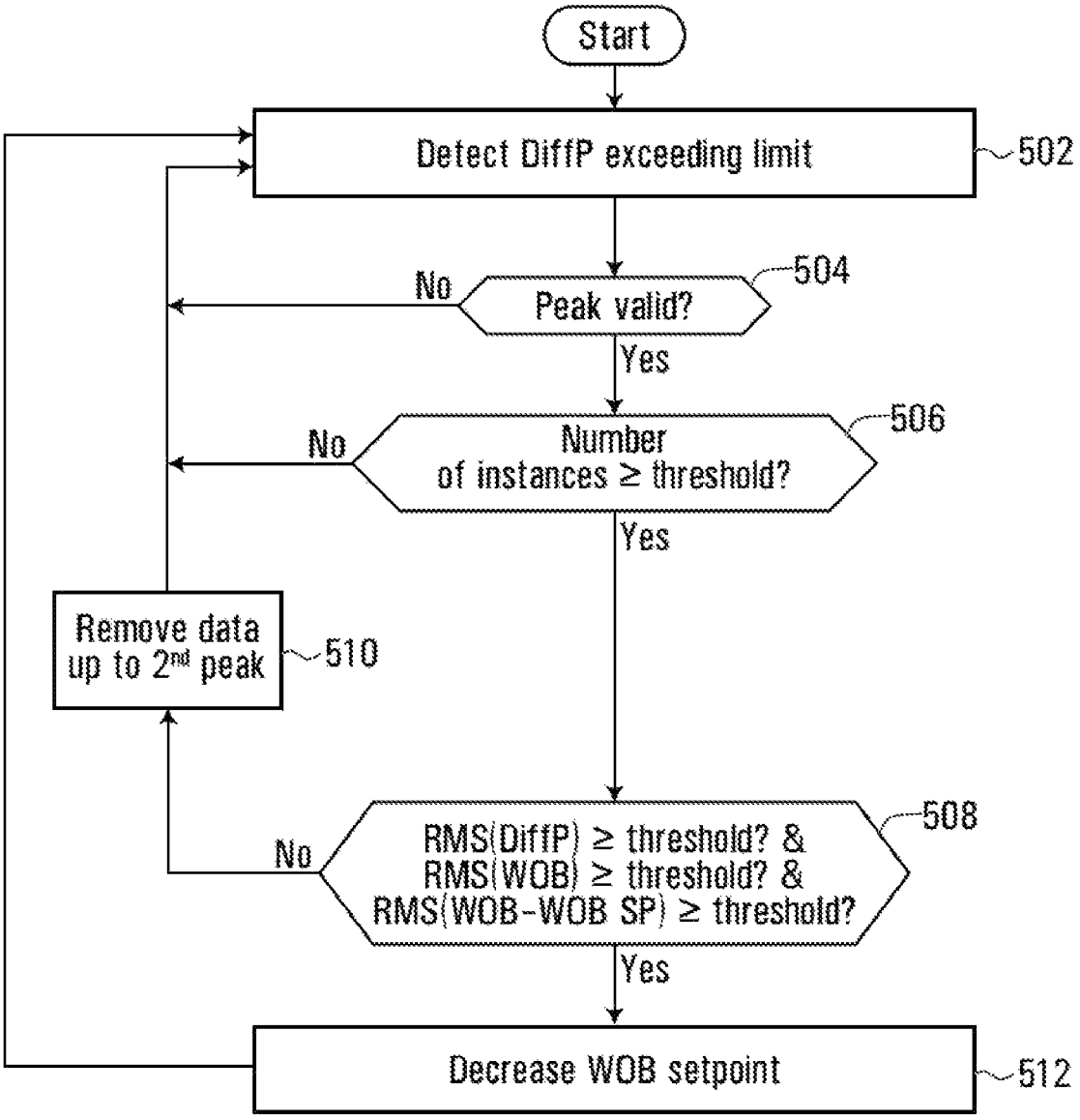
FIG. 5 depicts a flow diagram of a method of detecting that differential pressure is in an oscillating state, according to an embodiment of the disclosure.

Turning to FIG. 5, there is now shown a flow diagram of a method of detecting that differential pressure has entered an oscillating state. Differential pressure may be in an oscillating state when, for example, differential pressure has repeatedly exceeded its upper limit within a certain period of time. As discussed above, when differential pressure exceeds its upper limit, automated drilling unit 208 may behave undesirably, for example by inducing large swings in one or more other drilling parameters as automated drilling unit 208 attempts to correct for the differential pressure having exceeded its upper limit. Therefore, it can be useful to detect when differential pressure has entered an oscillating state.

The process begins at block 502 with oscillation detector 228 determining that differential pressure has exceeded a differential pressure limit (an event which may be referred to as a "peak"). For example, oscillation detector 228 may determine that differential pressure has exceeded a differential pressure limit using readings obtained from standpipe pressure sensor 202*d*, and comparing the readings to the differential pressure limit. When determining whether differential pressure has exceeded the differential pressure limit, oscillation detector 228 may detect both when differential pressure has exceeded the differential pressure limit, and when differential pressure drops back below the differential pressure limit, thereby recording a number instances, or peaks, that the differential pressure limit is exceeded. After a first peak is detected, oscillation detector 228 continues at block 502 to monitor differential pressure until a second peak is detected, i.e. until differential pressure is determined to have exceeded the differential pressure limit a second time. If a second peak is detected, the process proceeds to block 504.

At block 504, oscillation detector 228 determines the validly of a detected peak. A peak is determined to be valid if the peak occurs within a preset, configurable window of time since the immediately previous peak was detected. For example, a time interval of 5 seconds to 180 seconds may be used. If oscillation detector 228 determines that the detected peak is not valid (e.g. it was detected outside of the preset window of time since the immediately previous peak was detected), then oscillation detector 228 ignores the detected peak and the process returns to the initial state at block 502. If oscillation detector 228 determines that the detected peak is valid, then oscillation detector 228 increments the number of detected peaks by one and the process proceeds to block 506.

At block 506, oscillation detector 228 determines whether the total number of peaks detected within the time window exceeds a preset, configurable count threshold. For example, the threshold may be set to not less than a count of two peaks. If oscillation detector 228 determines that the number of counted peaks is less than the preset threshold, then the process returns to block 502. If oscillation detector 228 determines that the number of counted peaks is greater than or equal to the preset threshold, then the process proceeds to block 508.

At block 508, oscillation detector 228 determines the root mean square (RMS) of each of differential pressure, weight on bit, and the difference between weight on bit and a corresponding weight on bit setpoint, over the length of data collected since the detection of the first peak or since a period of time corresponding to the fixed time window, whichever is less. Oscillation detector 228 then compares the value of each RMS to a corresponding, configurable threshold value. The RMS of differential pressure is used to determine whether the oscillations in differential pressure are considered sufficiently significant. The RMS of weight on bit is used to determine whether the variations of weight on bit are considered sufficiently significant. The RMS of the difference between weight on bit and the weight on bit setpoint is used to determine whether setpoint tracking is lost. If oscillation detector 228 determines that one or more of the thresholds are not exceeded, then the process proceeds to block 510. If oscillation detector 228 determines that all thresholds are exceeded, then the process proceeds to block 512.

At block 510, oscillation detector 228 discards all data up to the second detected peak, and the process returns to block 502.

At block 512, oscillation detector 228 determines the average value of weight on bit over the length of data collected since the detection of the first peak or since a period of time corresponding to the fixed time window, whichever is less, to determine a target weight on bit. Oscillation detector 228 then decreases the weight on bit setpoint to the target weight on bit, by incrementing the weight on bit setpoint until the target weight on bit is reached.

Figure 6:
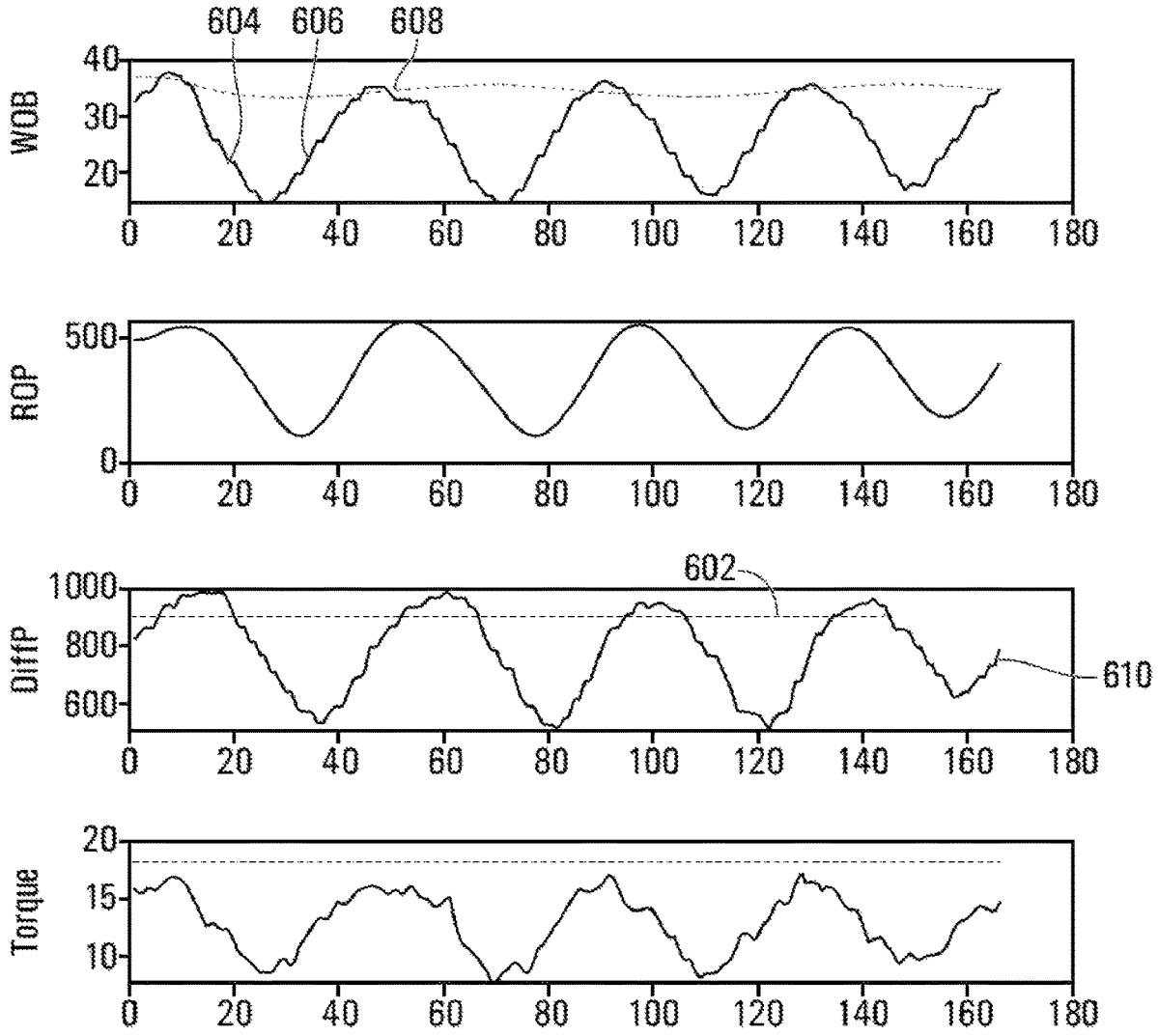
FIG. 6 depicts differential pressure interacting with a differential pressure limit, and the effects of differential pressure oscillations on weight on bit, rate of penetration, and torque, according to an embodiment of the disclosure.

Turning to FIG. 6, there is shown an example of differential pressure interacting with a differential pressure limit, and the effects of differential pressure oscillations on weight on bit, rate of penetration, and torque, without the benefit of an oscillation detector. The process starts when differential pressure hits the differential pressure limit 602. This causes the AutoDriller to switch control from weight on bit control to differential pressure control. The AutoDriller reduces the rate of release of the drill string but overcompensates causing a large deviation from the setpoint. The large change in weight on bit seen at 604 is a by-product of the reduction in the rate of release by the AutoDriller in response to the interaction of differential pressure with differential pressure limit 602. Then, the AutoDriller switches back to weight on bit control at 606. This causes weight on bit to rise to reach its setpoint 608, which causes differential pressure to again hit its limit at 610, restarting the whole process and causing an oscillation state.

Figure 7:
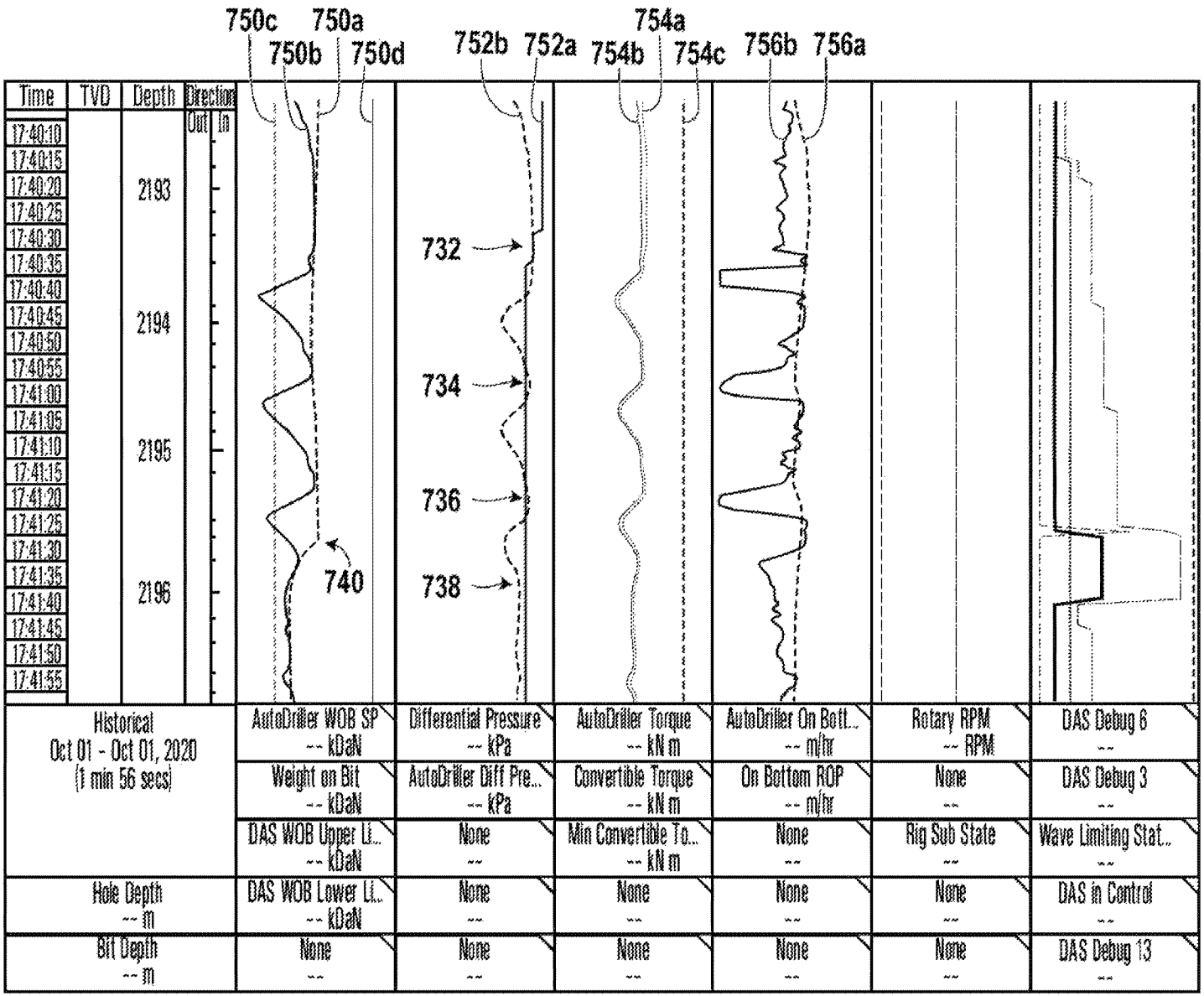
FIG. 7 depicts an example of the detection and mitigation of an oscillatory state of differential pressure, according to an embodiment of the disclosure.

Now turning to FIG. 7, there is shown a similar situation but with the benefit of an oscillation detector. In particular, there is shown a plot of differential pressure exceeding a differential pressure limit 738 three times (732, 734, 736), resulting in oscillation detector 228 determining that differential pressure has entered an oscillating state. In response, oscillation detector 228 reduces WOB setpoint 740, resulting in a stabilization of differential pressure beneath differential pressure limit 738. 750*a* is the AutoDriller WOB setpoint, 750*b* is weight on bit, 750*c* is DAS WOB lower limit, 750*d* is DAS WOB upper limit, 752*a* is the AutoDriller differential pressure setpoint, 752*b* is the differential pressure, 754*a* is convertible torque, 754*b* is the minimum convertible torque, 754*c* is the AutoDriller torque setpoint, 756*a* is the AutoDriller on bottom ROP setpoint, and 756*b* is the on bottom ROP.

As discussed above, in addition to controlling weight on bit so as to avoid differential pressure entering an oscillating state, embodiments described herein are also directed at controlling differential pressure so as to maintain differential pressure at or close to a target differential pressure or a target range of differential pressure ("target differential pressure range").

At the same time, drilling optimization systems, or subroutines that manage different objectives (e.g., stick-slip, mud motor stalls, rotating control device (RCD) events), typically require moderate control of one or more drilling parameters, such as WOB and RPM. Such drilling optimization systems and/or subroutines may be directly or indirectly integrated with an automated drilling unit. In the latter case, a drilling optimization system and/or subroutines may communicate with the automated drilling unit, providing drilling parameter setpoint commands, based on measurements of drilling parameters. It is desirable for the automated drilling unit to maintain stable control of the process, including a relatively smooth differential pressure. Examples of drilling optimization systems and/or subroutines are provided in U.S. Pat. No. 10,202,837, assigned to Pason Systems Corp., incorporated by reference in its entirety.

The methods now described, which may be included with or be separate to a drilling optimization system, are designed to assist the automated drilling unit in managing differential pressure. The primary objectives of the automated differential pressure management methods described herein include:

- maintaining differential pressure at, below, or within reasonable proximity to a prescribed differential pressure limit;
- maintaining differential pressure within a prescribed differential pressure range; and
- maintaining differential pressure within a prescribed differential pressure range while allowing one or more subroutine, for example the optimization of an objective function, to continue to operate normally.

Maintaining differential pressure at or below a specified level is typically accomplished by setting a limit on the automated drilling unit. However, in some cases, tuning or control design may be suboptimal, leading to differential pressure exceeding the limit, or the inability to sustain differential pressure within acceptable tolerances of the prescribed limit. A secondary control algorithm may therefore be useful in assisting the automated drilling unit to enforce the differential pressure limit.

In the case where a subroutine is concurrently run such that an objective function is to be minimized or maximized, the generalized optimization problem for N drilling parameters $x=\{x_1, \ldots, x_N\}$ can be represented as:

$$\max J(x) \text{ subject to } x_i^{LB} \le x_i \le x_i^{UB}, i=1, \ldots, N \quad (1)$$

where J is the objective function to be maximized (or minimized), and $\{x_i^{LB}, x_i^{UB}\}$ are the lower and upper bounds for each parameter $x_i$, respectively. In practice, the objective function typically consists of a combination of performance and efficiency metrics such as ROP and MSE (Mechanical Specific Energy), and the upper bounds correspond to automated drilling unit limits on drilling parameters such as WOB, torque, differential pressure, and SPP.

The optimization of J is realized through one or more inputs to the system. For example, WOB is typically used as an input. There exists a dependency between the drilling parameters and the inputs, for example WOB, governed by dynamics of the drilling process. In other words, $x_i=y_i(u, t)$ where $u=\{u_1, \ldots, u_M\}$ is the M inputs to the system, and t is time. The limits on each drilling parameter reduce the attainable combination of drilling parameters to a subset $Y \subset \mathbb{R}^N$. Limits on the input restrict the input space to a subset $U \subset \mathbb{R}^M$.

Figure 9:
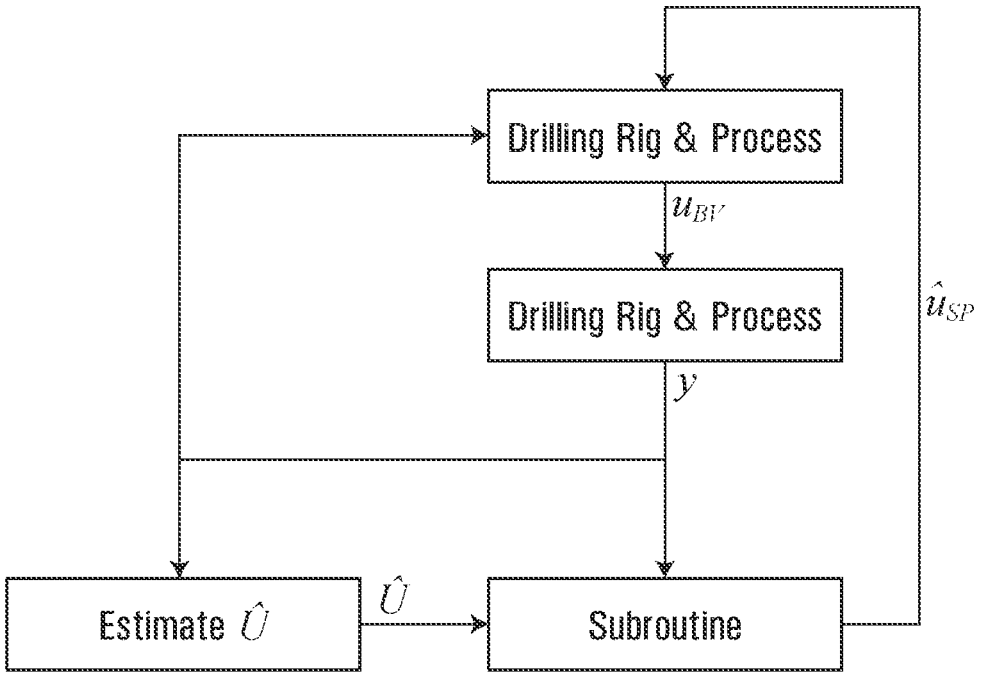
FIG. 9 is a block diagram of a system for determining a target drilling parameter range that is used by an AutoDriller and by a subroutine, according to an embodiment of the disclosure.

Additional limits on a particular drilling parameter, for example differential pressure, further reduce the attainable combination of drilling parameters to a subset $\hat{Y} \subset Y$. Subroutines that modify the input, for example an optimization routine, will look for a $\hat{u} \in \hat{U}$ that satisfies $y \in \hat{Y}$. Allowing subroutines, for example the optimization of J while maintaining differential pressure within a prescribed differential pressure range, requires the input space $\hat{U}$ to be determined. FIG. 9 shows the estimation of $\hat{U}$ and a process with the input to the automated drilling unit being driven by a subroutine. In this scheme, $\hat{u}_{SP}$ may be the AutoDriller setpoint that a subroutine selects, for example an optimal value for WOB. In this case, the AutoDriller input to the drilling rig is a drawworks speed command for the block velocity $u_{BV}$.

The restricted input space $\hat{U}$ may be determined by either manually setting limits on the input u, or through online estimation of $\hat{U}$ from the relationships between drilling parameters y and the input u. Online estimation of $\hat{U}$ may be advantageous to manually prescribing limits because the relationships between drilling parameters y and input u can vary significantly throughout the drilling process. The relationships between the drilling parameters and inputs may be determined from physical modelling of the process, statistical modelling, or hybrid approaches. The relationship between an input u and the corresponding target drilling parameter x* is described by the model $\hat{g}(\theta,x^*,x,t)$, where θ represents generalized parameters used in the model. The target range is prescribed and the workflow for determining $\hat{U}$ becomes:

1. Set the target range for the parameter such that $x^* \in [x^{LB}, x^{UB}]$
2. Estimate or update the model $u=\hat{g}(\theta,x^*,x,t)$
3. Calculate constraints $\hat{u}^{LB}=\hat{g}(\theta,x^{LB},t)$ and $\hat{u}^{UB}=\hat{g}(\theta,x^{UB},t)$
4. Send the updated constraints on u to the subroutine.

Due to the changing relationships between the drilling parameters and inputs, the estimate of $\hat{g}(\theta,x,u,t)$ is updated while the target parameter range is active. The frequency of the updates may be periodic, at fixed intervals, or triggered by a change such as a large deviation in one or more of the drilling parameters, or when the error between the predicted output and actual values of the function $\hat{g}(\theta,x,u,t)$, exceed prescribed tolerances. The limits on $\hat{u}_{SP}$ imposed by the subroutine such that $\hat{u}_{SP} \in [\tilde{u}^{LB}, \tilde{u}^{UB}]$ become:

Lower limit: $\tilde{u}^{LB}=\max(u^{LB}, \tilde{u}^{LB})$

Upper limit: $\tilde{u}^{LB}=\min(u^{UB}, \tilde{u}^{LB})$ where $u^{LB}$ and $u^{UB}$ may be lower and upper bounds, respectively, which are existing constraints imposed on the input not in consideration of the target drilling parameter range.

The setpoint $\hat{u}^{SP}$ is restricted to the range $\hat{U}=[\tilde{u}^{LB}, \tilde{u}^{UB}]$ while the value of $\hat{u}_{SP}$ is determined by an optimization routine such that $\hat{u}_{SP}=f_{opt}(\theta,x,t)$. Three ways in which the input constraints may be incorporated into the optimization include the following.

1. Add additional constraints on the input to the optimization problem itself described in Equation 1.

$$\max J(x, u) \text{ subject to } x_i^{LB} \le x_i \le x_i^{UB}, i=1, \ldots, N \text{ and } \tilde{u}^{LB} \le U \le \tilde{u}^{UB}$$

Figure 10:
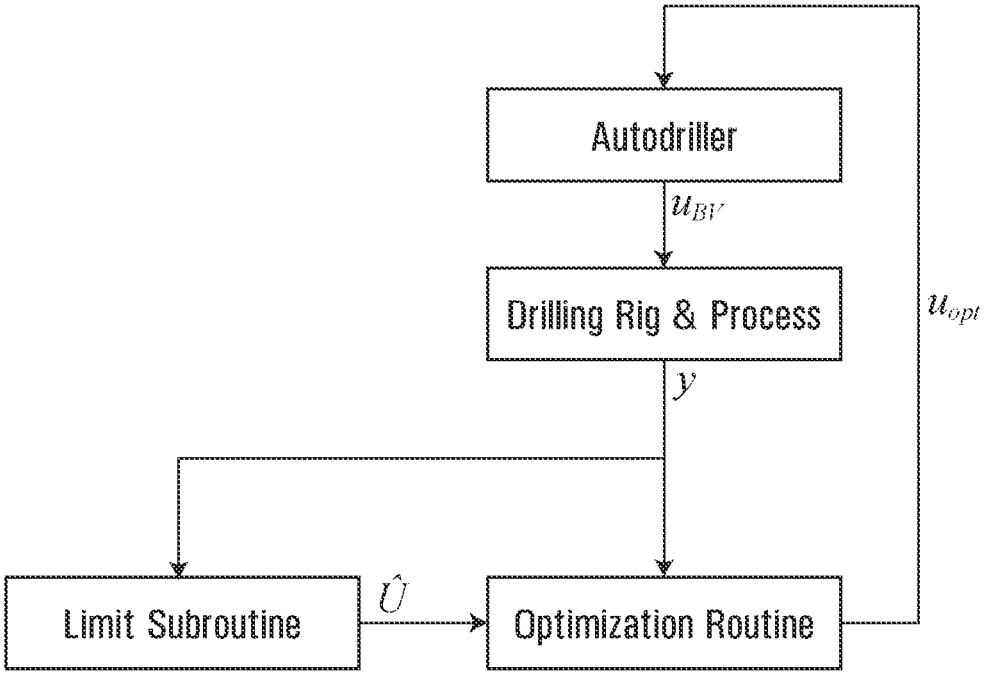
FIG. 10 is a block diagram of a system for determining a target drilling parameter range that is used by an optimization routine, according to an embodiment of the disclosure.

One advantage to this approach is that the constraints on the inputs are directly accounted for by the optimization routine, and no additional adjustments need to be made downstream. One disadvantage is the additional constraint may result in an infeasible solution to the optimization problem itself. A schematic is shown in FIG. 10.

Figure 11:
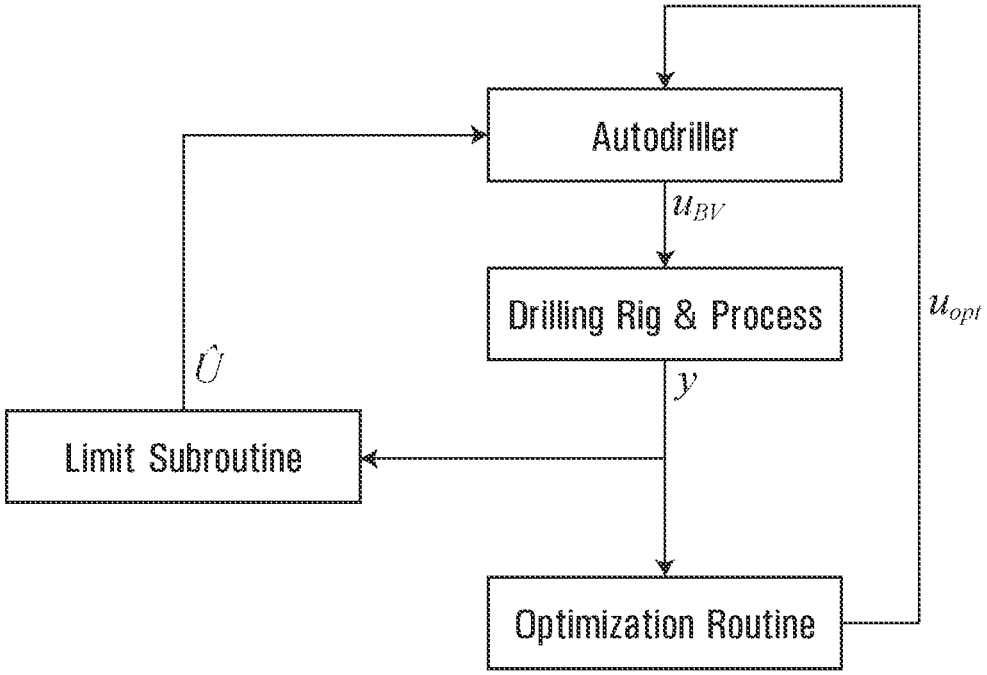
FIG. 11 depicts a block diagram of a system that estimates a target drilling parameter range that is used by an AutoDriller, according to an embodiment of the disclosure.

2. Feed the constraints directly to the automated drilling unit. One advantage with this method is that the constraints are strictly enforced by the automated drilling unit itself. In this way, the constraints become hard limits to the system since the automated drilling unit is designed to prevent drilling parameters, including an input, from exceeding setpoint limits. A disadvantage with this method is that the automated drilling unit may need to be redesigned if, for example, it does include an existing lower limit. Another disadvantage is that the automated drilling unit may be controlling to another drilling parameter, for example, an ROP limit rather than an optimal WOB setpoint generated by the optimization routine, resulting in conflicting drilling parameter targets. A schematic is shown in FIG. 11.

Figure 12:
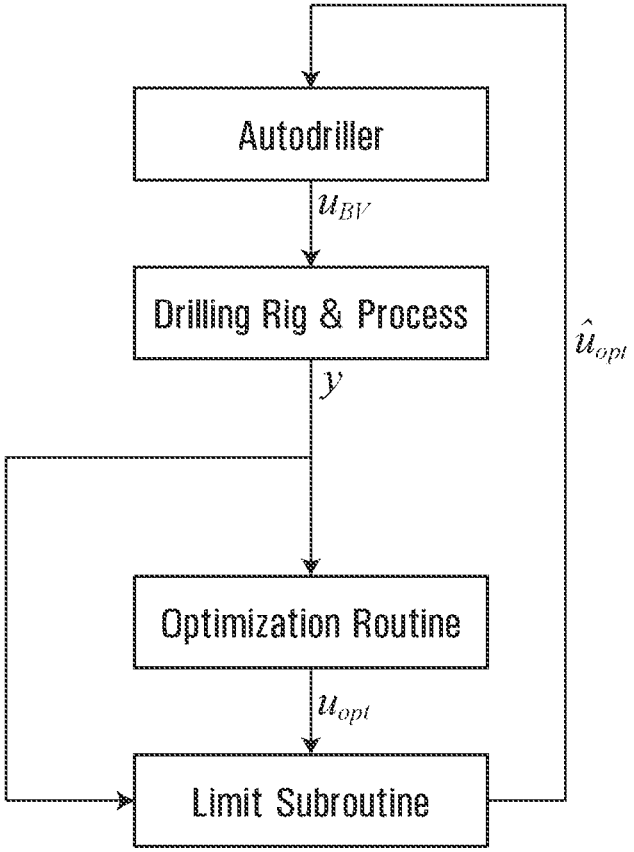
FIG. 12 depicts a block diagram of a system that estimates a target drilling parameter range that is applied following an optimization routine, according to an embodiment of the disclosure.

3. Add a subroutine that checks whether the input $u_{opt}$ generated by the optimization routine $f_{opt}(\theta,x,t)$ satisfies the constraints such that $u_{opt} \in [\hat{u}^{LB}, \hat{u}^{UB}]$. If the input does not satisfy the constraints, coerce the input generated by the optimization routine to values within the constrained input space. An advantage with this approach is added flexibility in managing the input with respect to other limits on the system. A disadvantage is the requirement for additional logic on top of the optimization routine, and the method for estimating limits on the input. A schematic is shown in FIG. 12.

Figure 13:
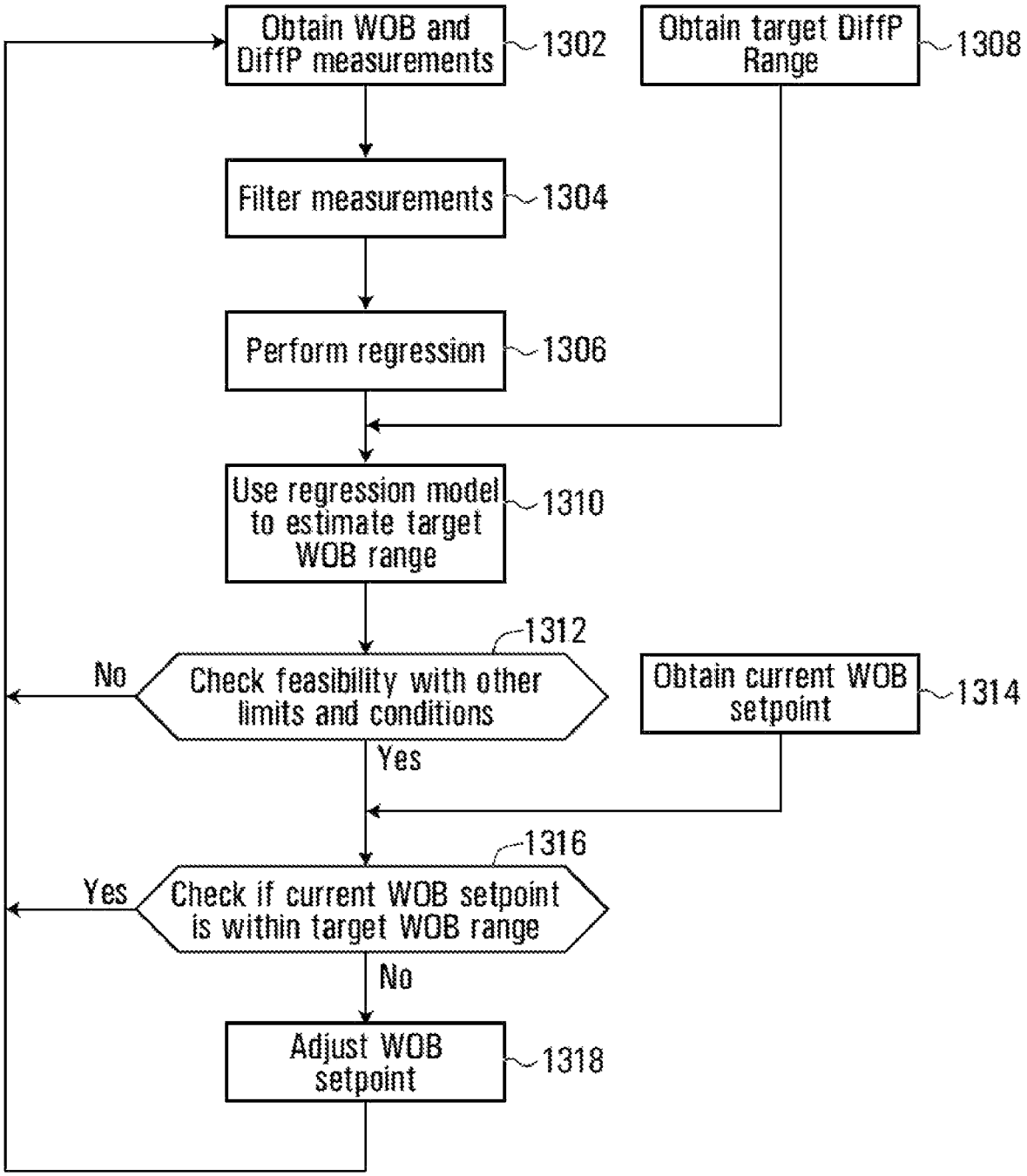
FIG. 13 depicts a flow diagram of a method of controlling differential pressure to a target differential pressure range, according to an embodiment of the disclosure.

Turning to FIG. 13, there will now be described a method of controlling differential pressure to a target differential pressure range, using target differential pressure range manager 224. Prior to commencing the process at block 1302, target differential pressure range manager 224 performs a number of checks. In particular, target differential pressure range manager 224 checks whether rotary drilling is proceeding, whether target differential pressure range manager 224 is not suspended by another subroutine, and whether the differential pressure setpoint, setpoint offset, and buffer are all valid.

At block 1302, target differential pressure range manager 224 collects a preset window of weight on bit and differential pressure measurements. For example, target differential pressure range manager 224 may collect weight on bit and differential pressure measurements from readings obtained by hookload sensor 202*c* and standpipe pressure sensor 202*d*, respectively.

At block 1304, target differential pressure range manager 224 filters out outlier measurements by discarding measurements that fall outside of a preset range, and smooths weight on bit and differential pressure measurements by averaging the signals over a prescribed window length.

At block 1306, target differential pressure range manager 224 performs regression to fit a model between weight on bit and differential pressure. The model output is an estimated weight on bit dependent on a differential pressure input.

At block 1308, the target differential pressure range is obtained from one or more user inputs to HMI 230. The input values are a differential pressure offset and a differential pressure buffer. The target differential pressure range upper limit is calculated as the differential pressure setpoint minus the differential pressure offset. The target differential pressure range lower limit is calculated as the target differential pressure range upper limit minus the differential pressure buffer.

At block 1310, the target weight on bit range is obtained by using the regression model determined at block 1306. The target weight on bit range upper limit is calculated using the target differential pressure range upper limit at block 1308. The target weight on bit range lower limit is calculated using the target differential pressure lower limit at block 1308.

At block 1312, target differential pressure range manager 224 determines the feasibility of the target weight on bit range. For example, target differential pressure range manager 224 may compare the target weight on bit range upper and lower limits determined at block 1310 to prescribed upper and lower limits on weight on bit. If the target weight on bit range upper limit is greater than the prescribed upper limit, then the target weight on bit range upper limit may be set to the prescribed upper limit. Similarly, if the target weight on bit range lower limit is below the prescribed lower limit, then the target weight on bit range lower limit may be set to the prescribed lower limit. If the target weight on bit range is completely infeasible, for example if the target weight on bit range upper limit is below the prescribed weight on bit lower limit, then the process returns to block 1302. Otherwise, the process continues to block 1314.

At block 1314, the current weight on bit setpoint is determined. The current weight on bit setpoint may be a user-prescribed value, or a recommended value determined from another subroutine, for example a routine that optimizes ROP using weight on bit, or the differential pressure manager setpoint at block 1318 calculated in a previous iteration.

At block 1316, target differential pressure range manager 224 determines if the current weight on bit setpoint is within the target weight on bit range. If the current weight on bit setpoint is within the target weight on bit range, then the process returns to block 1302. If the current weight on bit setpoint is outside the target weight on bit range, then the process proceeds to block 1318.

At block 1318, target differential pressure range manager 224 adjusts the current weight on bit setpoint to a target weight on bit setpoint value within the target weight on range. The weight on bit setpoint is adjusted to a value within the target weight on bit range if the difference between the current weight on bit setpoint and the nearest target weight on bit range limit exceeds a configurable threshold. The target weight on bit setpoint value is equal to:

If current weight on bit setpoint>target weight on bit range upper limit:

minimum(target weight on bit range upper limit−constant, midpoint of target weight on bit range)

If current weight on bit setpoint<target weight on bit range lower limit:

minimum(target weight on bit range lower limit+constant, midpoint of target weight on bit range)

In this case, the current weight on bit setpoint may be changed over a period of time to avoid large instantaneous changes in the weight on bit setpoint. In practice, the threshold may be 2 kDaN, and the time interval no longer than 30 seconds.

The weight on bit setpoint is adjusted to the nearest weight on bit target range limit if the difference between the current weight on bit setpoint and the nearest weight on bit target range limit does not exceed a threshold. Once the change in the weight on bit setpoint is completed, the process returns to block 1302.

The above description in the context of FIGS. 9-13 is intended for use when, for example, the driller wants does not wish to drill at a constant differential pressure, and the optimization of one or more other drilling parameters, such as ROP, is a priority. On the other hand, if the driller wishes to drill at or close to a specific, target differential pressure, then, as now described, there may be used a method of controlling differential pressure to such a target differential pressure, using target differential pressure manager 226.

Figure 14:
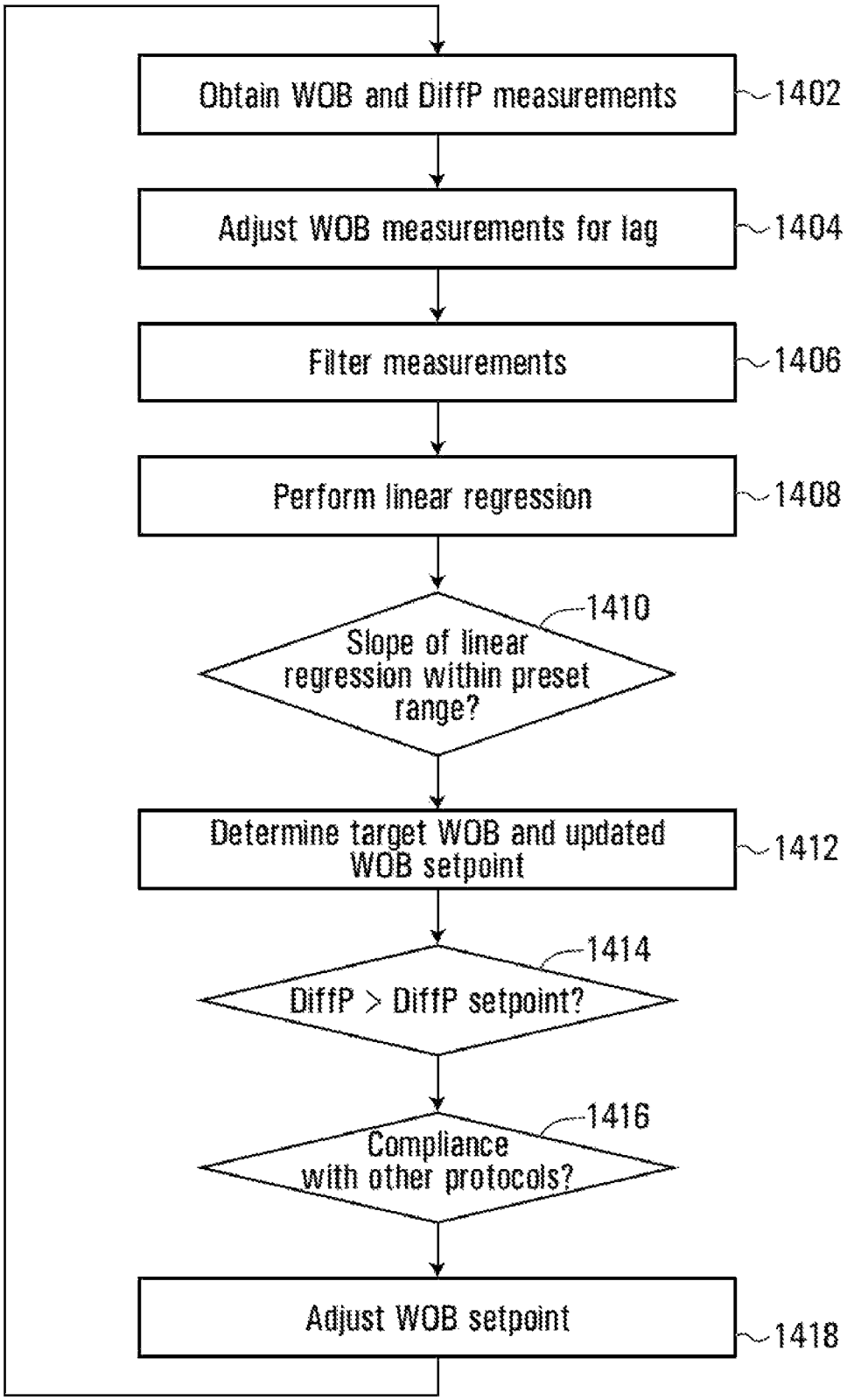
FIG. 14 depicts a flow diagram of a method of controlling differential pressure to a target differential pressure, according to an embodiment of the disclosure.

Turning to FIG. 14, there is now be described a method of controlling differential pressure to a target differential pressure, using target differential pressure manager 226. Prior to commencing the process at block 1402, target differential pressure manager 226 performs a number of checks. In particular, target differential pressure manager 226 checks whether rotary drilling is proceeding, whether target differential pressure manager 226 is not suspended by another protocol, and whether the differential pressure setpoint is valid (e.g. whether the driller has entered a differential pressure setpoint).

At block 1402, target differential pressure manager 226 collects a preset window of weight on bit and differential pressure measurements. For example, target differential pressure manager 226 may collect weight on bit and differential pressure measurements from readings obtained by hookload sensor 202*c* and standpipe pressure sensor 202*d*, respectively. At block 1404, target differential pressure manager 226 adjusts the weight on bit measurements for lag relative to the differential pressure measurements. In particular, target differential pressure manager 226 assumes that differential pressure measurements lag weight on bit measurements by an amount ranging from 0 to a preset maximum. The lag is determined by cross correlation of the difference arrays between the weight on bit measurements and the differential pressure measurements.

At block 1406, target differential pressure manager 226 filters out outlier measurements by discarding measurements that fall outside of a preset percentile range. At block 1408, target differential pressure manager 226 performs linear regression on the filtered weight on bit and differential pressure measurements. At block 1410, target differential pressure manager 226 determines whether the slope of the output of the linear regression is between a preset minimum slope and a preset maximum slope. If not, then the slope is clamped so that the slope is restricted to being between the preset minimum slope and the preset maximum slope. If not, then no clamping occurs. The process then proceeds to block 1412.

Based on the output of the linear regression, at block 1412, target differential pressure manager 226 determines a target weight on bit that is estimated to correspond to the target differential pressure. Based on the target weight on bit, target differential pressure manager 226 then determines an updated weight on bit setpoint. In particular, target differential pressure manager 226 may determine the updated weight on bit setpoint based on (target weight on bit−current weight on bit setpoint)*dpmax.gain, wherein dpmax.gain is a constant. The change to the weight on bit setpoint is constrained to a maximum limit.

Furthermore, target differential pressure manager 226 will not increase the weight on bit setpoint if any of the following conditions holds true. In particular, at block 1414, target differential pressure manager 226 determines whether the current differential pressure is greater than the differential pressure setpoint. If it is, then target differential pressure manager 226 determines that the weight on bit setpoint cannot be increased, although it may be decreased. If the current differential pressure is not greater than the differential pressure setpoint, or if the current differential pressure is greater than the differential pressure setpoint but the weight on bit setpoint is to be decreased, then the method proceeds to block 1416. Otherwise, the process returns to block 1402.

At block 1416, target differential pressure manager 226 determines whether increasing the weight on bit setpoint would keep the system in compliance with one or more other protocols, such as a stick slip protocol and a limiting protocol. A limiting protocol may be a protocol that determines whether a drilling parameter such as differential pressure, torque, or rate of penetration is too close to or beyond an associated limit.

If the setpoint change results in a greater setpoint tracking error and is greater than a preset threshold, then no setpoint change is made. For instance, if the weight on bit is x and the weight on bit setpoint is y>x+threshold, then target differential pressure manager 226 will not increase the weight on bit setpoint because that would increase the distance between the weight on bit and the weight on bit setpoint.

If increasing the weight on bit setpoint would keep the system in compliance with the one or more other protocols, or if increasing the weight on bit setpoint would not keep the system in compliance with the one or more other protocols but the weight on bit setpoint is to be decreased, then the method proceeds to block 1418. Otherwise, the process returns to block 1402.

At block 1418, the weight on bit setpoint is adjusted based on the updated weight on bit setpoint determined at block 1412. An additional constraint that is imposed is that the weight on bit setpoint change over the past minute is not to exceed a preset maximum. Furthermore, target differential pressure manager 226 may determine a linear regression of the differential pressure over time over a preset window (in one non-limiting example, about 30 seconds). If the slope is positive and is above a threshold, then target differential pressure manager 226 may prevent the weight on bit setpoint from being increased. If the slope is negative and below a threshold, then target differential pressure manager 226 may prevent the weight on bit setpoint from being decreased. The purpose of this is to dampen the weight on bit setpoint changes to allow time to see the differential pressure response before making further changes. After block 1418, the process returns to block 1402.

Figure 8:
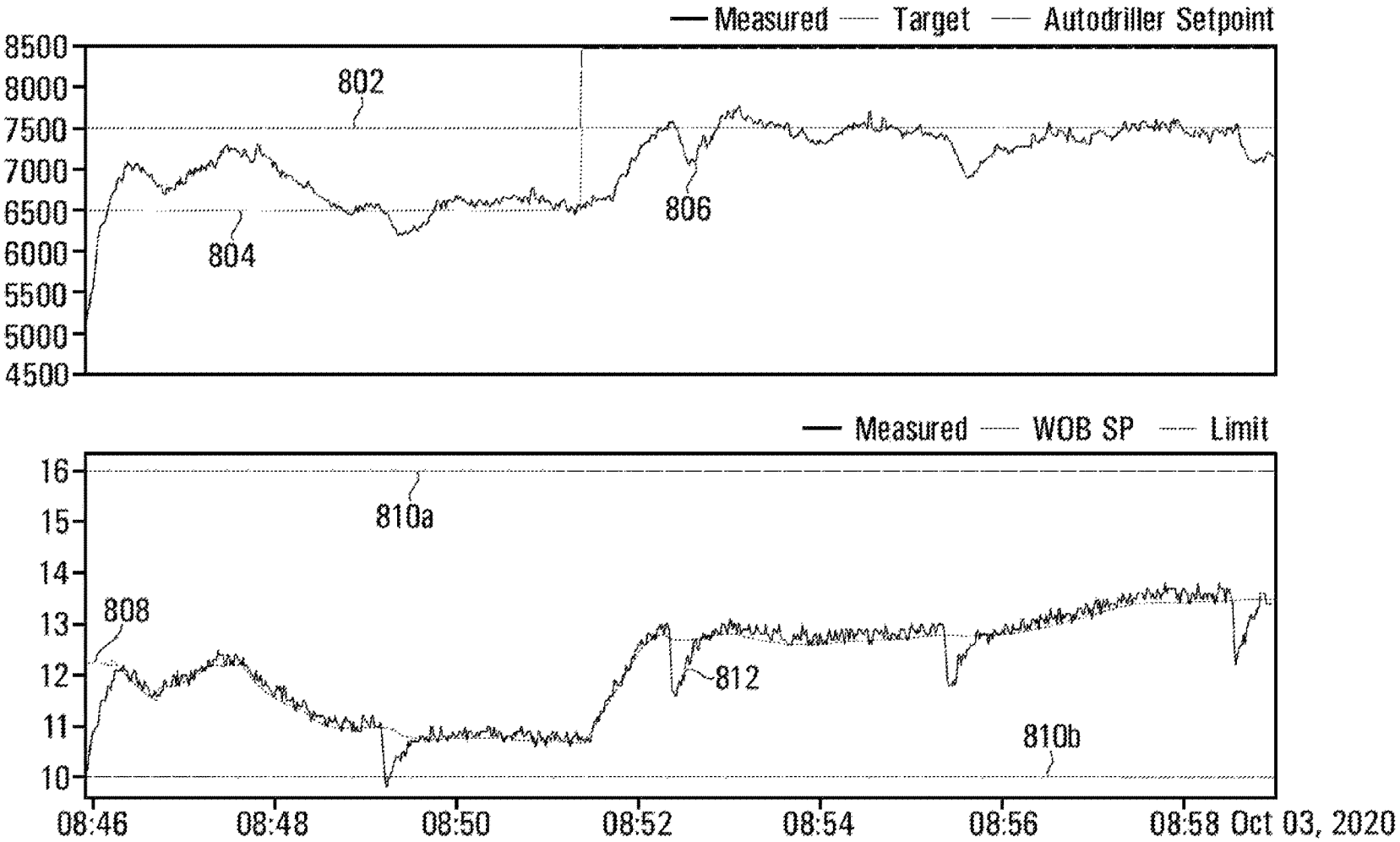
FIG. 8 depicts an example of controlling differential pressure to a target differential pressure, according to an embodiment of the disclosure.

Turning to FIG. 8, there is shown an example of target differential pressure manager 226 in use. In particular, at (1), target differential pressure manager 226 activates and the differential pressure is determined to be above the target differential pressure. Target differential pressure manager 226 decreases the weight on bit setpoint, leading to the differential pressure approaching the target differential pressure. At (2), the driller raises the differential pressure setpoint, which in turn raises the differential pressure target. With the increased differential pressure target, target differential pressure manager 226 increases the weight on bit setpoint, leading to the differential pressure approaching the new target differential pressure. 802 is the differential pressure setpoint, 804 is the target differential pressure, 806 is the measured differential pressure, 808 is the weight on bit setpoint, 810*a* and 810*b* are weight on bit limits, and 812 is the measured weight on bit.

Figure 15:
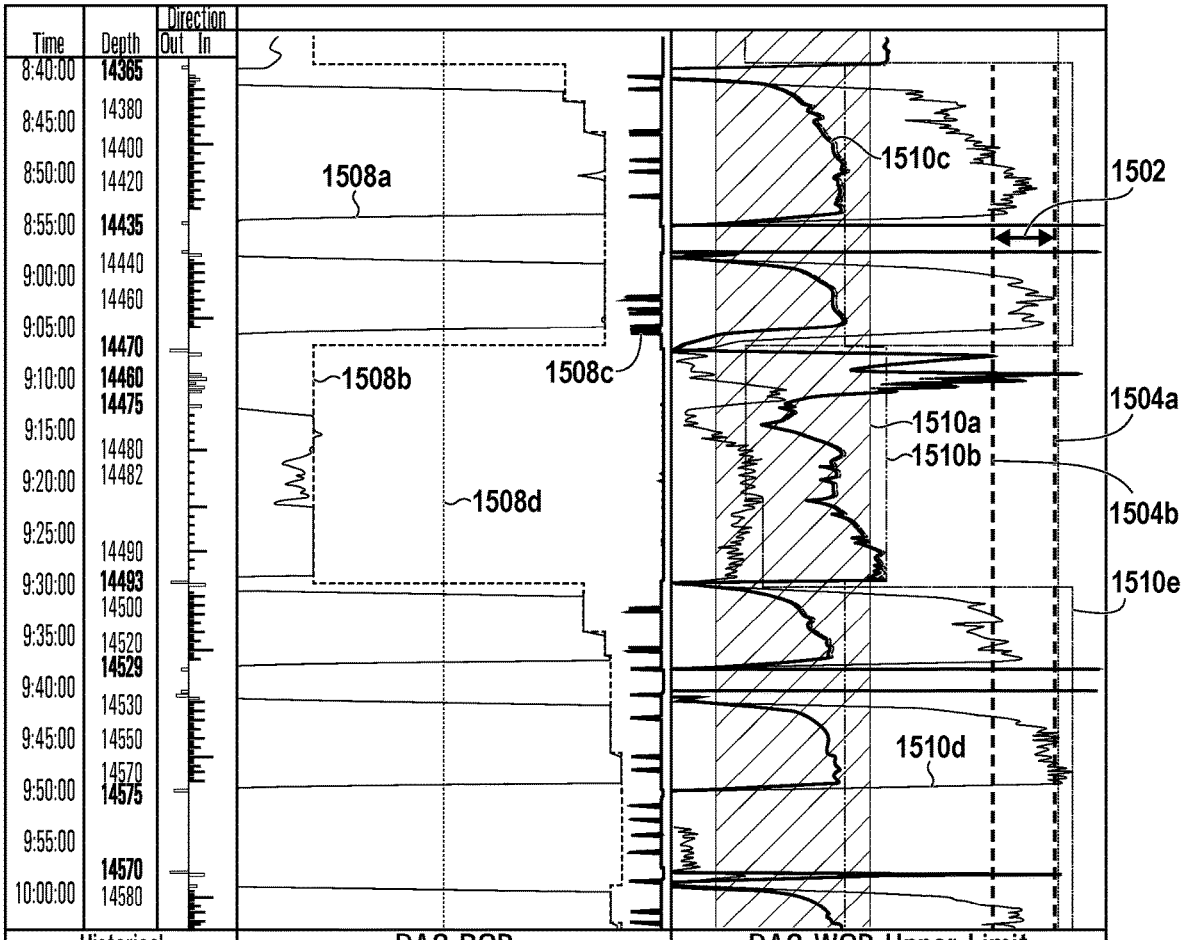
FIG. 15 depicts several example stands of rotary drilling wherein it would be desirable to control differential pressure to a differential pressure range.

Turning to FIG. 15, there is shown a series of stands of drilling without any active differential pressure management. The stands are depicted in terms of displayed time series for drilling parameter measurements including weight on bit and differential pressure, together with their respective limits. The dashed lines illustrate upper and lower limits of an example of a target differential pressure range 1502, where the upper dashed line 1504*a* represents the target differential pressure range upper limit which is offset below a differential pressure limit (the differential pressure setpoint). The lower dashed line 1504*b* represents the target differential pressure range lower limit which is offset below the target differential pressure range lower limit by a buffer. When differential pressure manager is not active, it can be seen that, at times, the measured differential pressure signal is outside of the upper and lower limits 1504*a*, 1504*b*. 1508*a* is the on bottom ROP, 1508*b* is the AutoDriller on bottom ROP setpoint, 1508*c* is DAS ROP, 1508*d* is Wave WOB correlation, 1510*a* is DAS WOB upper limit, 1510*b* is the AutoDriller WOB setpoint, 1510*c* is weight on bit, 1510*d* is differential pressure, and 1510*e* is the AutoDriller differential pressure setpoint.

Figure 16:
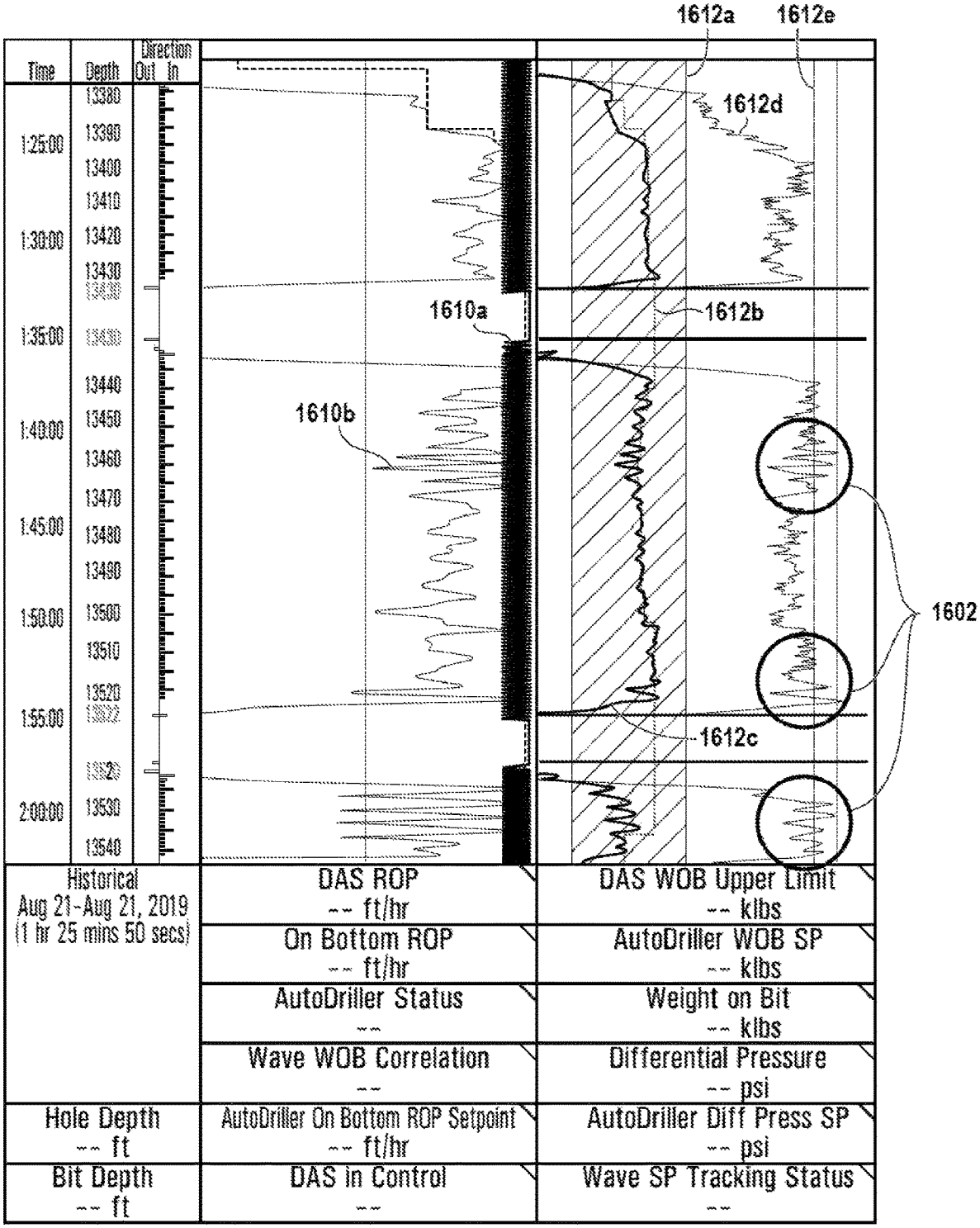
FIG. 16 depicts several example stands of rotary drilling wherein it would be desirable to control differential pressure to a differential pressure range.

Turning to FIG. 16, there is shown a series of stands including rotary drilling, without any of target differential pressure range manager 224, target differential pressure manager 226, and oscillation detector 228 active. The stands are depicted in terms of displayed time series for drilling parameter measurements including weight on bit and differential pressure, together with their respective limits. Oscillatory behaviour of the differential pressure signal can be observed in the highlighted regions 1602. The differential pressure oscillation peaks exceed the differential pressure limit. Oscillations in several other drilling parameters related to those in differential pressure can also be seen. The oscillations shown in FIG. 16 are the result of the response of an AutoDriller to differential pressure at or exceeding the differential pressure limit. The behaviour may be corrected by activating target differential pressure range manager 224, target differential pressure manager 226, and/or oscillation detector 228 to mitigate or prevent the behaviour by setting the weight on bit setpoint to a lower value. 1610*a* is DAS ROP, 1610*b* is on bottom ROP, 1612*a* is DAS WOB upper limit, 1612*b* is the AutoDriller WOB setpoint, 1612*c* is weight on bit, 1612*d* is differential pressure, and 1612*e* is the AutoDriller differential pressure setpoint.

Figure 17:
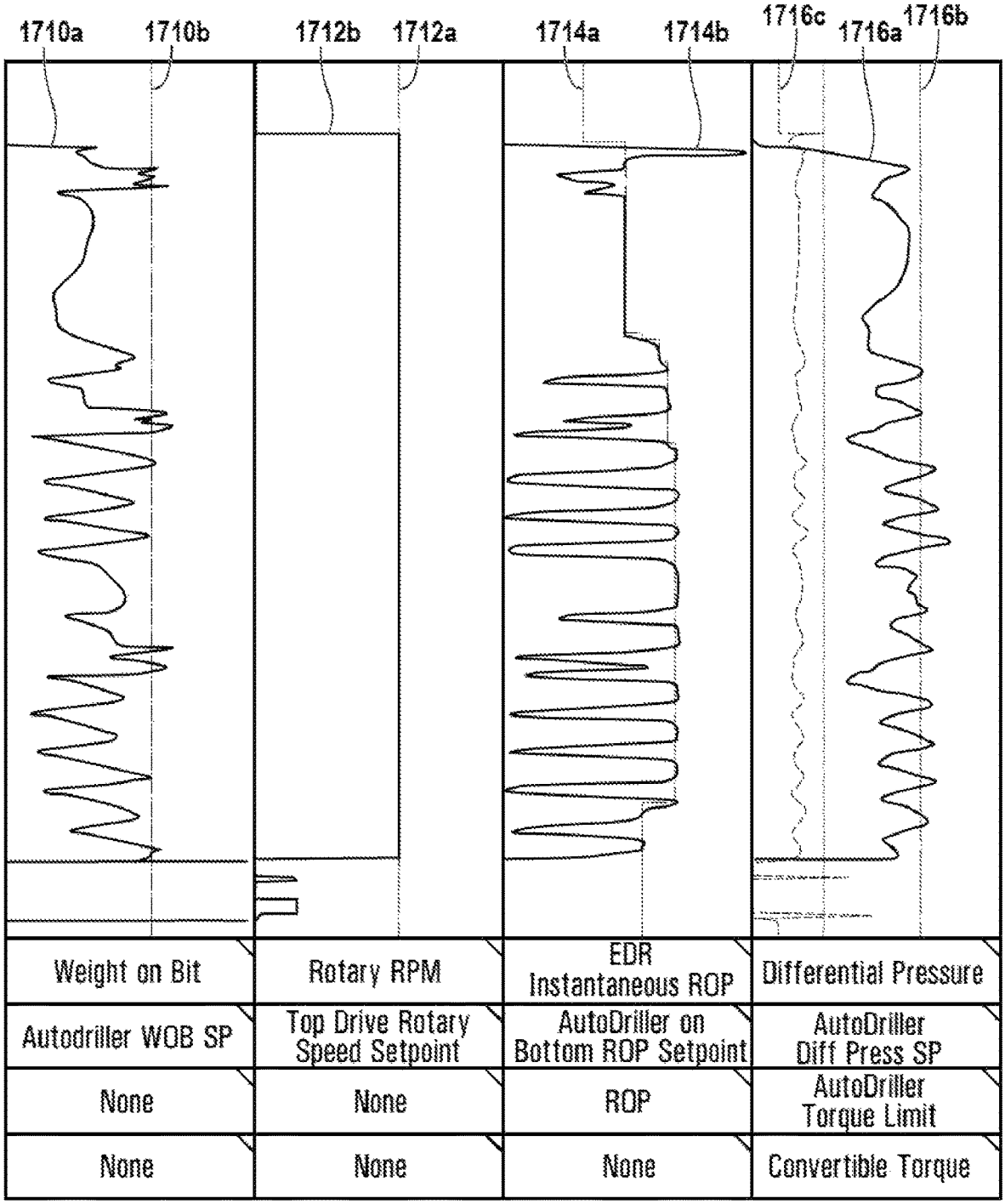
FIG. 17 depicts differential pressure interacting with a differential pressure limit, and the effects of differential pressure oscillations on weight on bit, rate of penetration, and torque, according to an embodiment of the disclosure.

Turning to FIG. 17, there is shown a series of stands including rotary drilling, without any of target differential pressure range manager 224, target differential pressure manager 226, and oscillation detector 228 active. The stands are depicted in terms of displayed time series for drilling parameter measurements including weight on bit and differential pressure, together with their respective limits. Oscillatory behaviour of the differential pressure signal can be observed throughout the stand. The differential pressure and weight on bit oscillation peaks exceed the respective differential pressure and weight on limits. Oscillations in other drilling parameters related to those in differential pressure and weight on bit can also be seen. The oscillations shown in FIG. 17 are the result of the response of an AutoDriller to differential pressure at or exceeding the differential pressure limit. The behaviour may be corrected by activating target differential pressure range manager 224, target differential pressure manager 226, and/or oscillation detector 228 to mitigate or prevent the behaviour by setting the weight on bit setpoint to a lower value. 1710*a* is weight on bit, 1710*b* is the AutoDriller WOB setpoint, 1712*a* is the top drive rotary speed setpoint, 1712*b* is the rotary RPM, 1714*a* is the AutoDriller on bottom ROP setpoint, 1714*b* is ROP, 1716*a* is the differential pressure, 1716*b* is the AutoDriller differential pressure setpoint, and 1716*c* is convertible torque.

Figure 18:
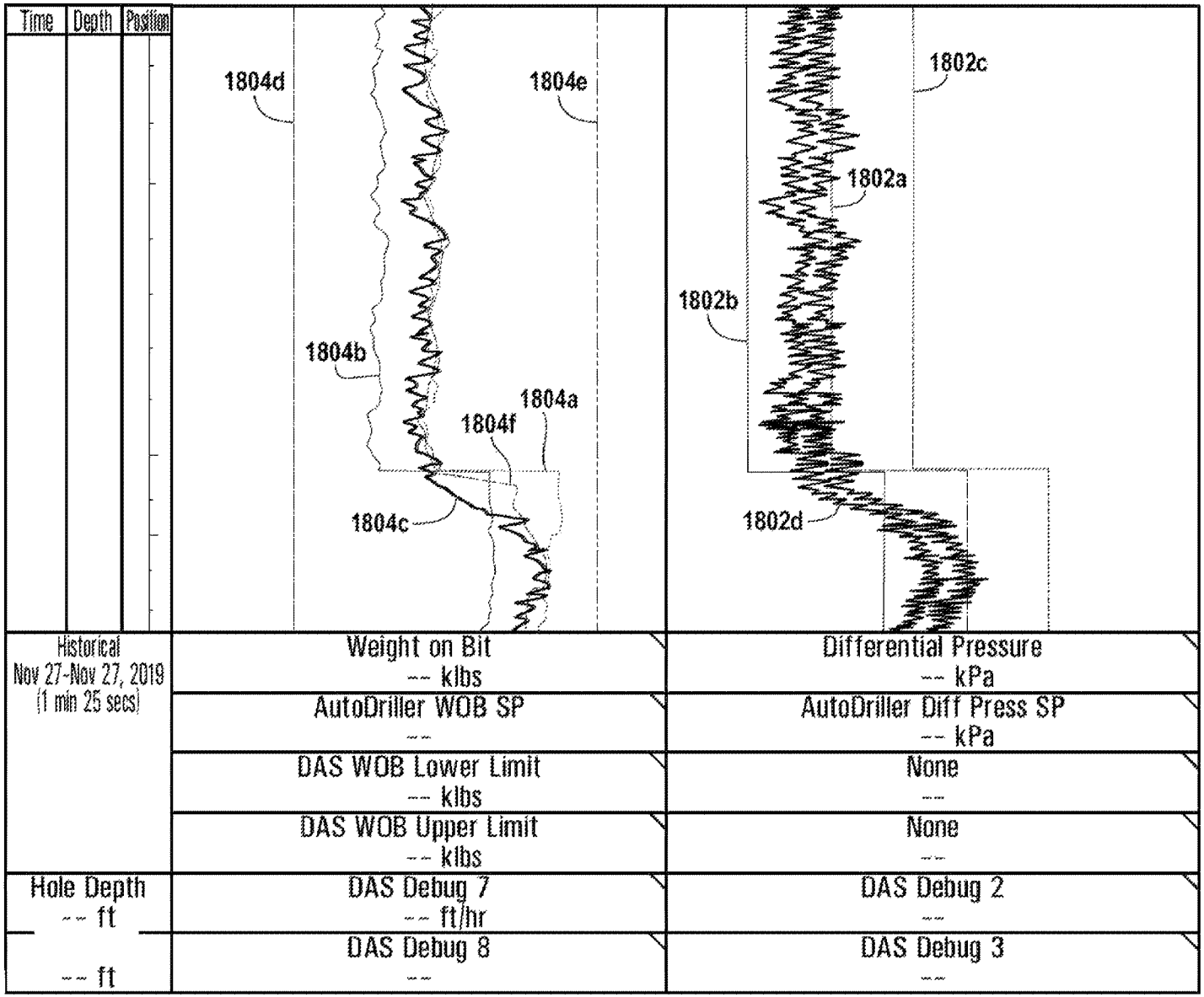
FIG. 18 depicts an example of a method of maintaining differential pressure within a target differential pressure range, while allowing a separate routine to control weight on bit, according to an embodiment of the disclosure

Turning to FIG. 18, there is shown a section of a stand of rotary drilling with differential pressure management active. The stand is depicted in terms of displayed time series for drilling parameter measurements including weight on bit and differential pressure, together with their respective limits. The target differential pressure range upper limit 1802*a* is shown as DAS_DEBUG_3 and the target differential pressure range lower limit 1802*b* is shown as DAS_DEBUG_2. Together, they define the target differential pressure range. The target weight on bit range is shown in the first column. The target weight on bit range upper limit 1804*a* is shown as DAS_DEBUG_8, and corresponds to differential pressure range upper limit 1802*a*. The target weight on bit range lower limit 1804*b* is shown as DAS_DEBUG_7, and corresponds to differential pressure range lower limit 1802*b*. One can note that the target weight on bit range changes over time and depth. This is due to target differential pressure range manager 224 continuously updating the model of the relationship between weight on bit and differential pressure to account for the non-stationarity of the process. An optimization subroutine is concurrently running with target differential pressure range manager 224 which must adjust the weight on bit setpoint recommended by the optimization subroutine to maintain the weight on bit setpoint within the target weight on bit range. A manual change to the differential pressure limit can be seen just after 13712 ft. Target differential pressure range manager 224 recalculates the target differential pressure range and corresponding target weight on bit range. The weight on bit setpoint is initially outside of the target weight on bit range. Target differential pressure range manager 224 ramps the weight on bit setpoint to within the target weight on bit range, and then allows for the optimization subroutine to proceed. 1804*c* is weight on bit, 1804*d* is DAS WOB lower limit, 1804*e* is DAS WOB upper limit, 1804*f* is the AutoDriller WOB setpoint, 1802*c* is the AutoDriller differential pressure setpoint, and 1802*d* is the differential pressure.

While particular embodiments have been described in the foregoing, it is to be understood that other embodiments are possible and are intended to be included herein. It will be clear to any person skilled in the art that modifications of and adjustments to the foregoing embodiments, not shown, are possible.

As an example, in the depicted embodiments the drawworks 114 is used to raise and lower the drill string 118. In different embodiments (not depicted), a different height control apparatus for raising or lowering the drill string 118 may be used. For example, hydraulics may be used for raising and lowering the drill string 118. In embodiments in which hydraulics are used, the traveling block 108 may be omitted and consequently the processor 212 does not use the height of the block 108 as a proxy for drill string height, as it does in the depicted embodiments. In those embodiments, the processor 212 may use output from a different type of height sensor to determine drill string position and ROP. For example, the motion of the traveling block 108 may be translated into rotary motion and rotary motion encoder may then be used to digitize readings of that motion. This may be done using a roller that runs along a rail or, if crown sheaves are present, the encoder may be installed on the sheaves' axel. Various gears may also be present as desired. As additional examples, laser based motion measurements may be taken, a machine vision based measurement system may be used, or both.

While a single processor 212 is depicted in FIG. 2A, in different embodiments (not depicted) the processor 212 may comprise multiple processors, one or more microprocessors, or a combination thereof. Similarly, in different embodiments (not depicted) the single memory 214 may comprise multiple memories. Any one or more of those memories may comprise, for example, mass memory storage, ROM, RAM, hard disk drives, optical disk drives (including CD and DVD drives), magnetic disk drives, magnetic tape drives (including LTO, DLT, DAT and DCC), flash drives, removable memory chips such as EPROM or PROM, or similar storage media as known in the art.

In different embodiments (not depicted), the computer 210 may also comprise other components for allowing computer programs or other instructions to be loaded. Those components may comprise, for example, a communications interface that allows software and data to be transferred between the computer 210 and external systems and networks. Examples of the communications interface comprise a modem, a network interface such as an Ethernet card, a wireless communication interface, or a serial or parallel communications port. Software and data transferred via the communications interface are in the form of signals which can be electronic, acoustic, electromagnetic, optical, or other signals capable of being received by the communications interface. The computer 210 may comprise multiple interfaces.

In certain embodiments (not depicted), input to and output from the computer 210 is administered by an input/output (I/O) interface. In these embodiments the computer 210 may further comprise a display and input devices in the form, for example, of a keyboard and mouse. The I/O interface administers control of the display, keyboard, and mouse. In certain additional embodiments (not depicted), the computer 210 also comprises a graphical processing unit. The graphical processing unit may also be used for computational purposes as an adjunct to, or instead of, the processor 210.

In all embodiments, the various components of the computer 210 may be communicatively coupled to one another either directly or indirectly by shared coupling to one or more suitable buses.

Directional terms such as "top", "bottom", "up", "down", "front", and "back" are used in this disclosure for the purpose of providing relative reference only, and are not intended to suggest any limitations on how any article is to be positioned during use, or to be mounted in an assembly or relative to an environment. The term "couple" and similar terms, and variants of them, as used in this disclosure are intended to include indirect and direct coupling unless otherwise indicated. For example, if a first component is communicatively coupled to a second component, those components may communicate directly with each other or indirectly via another component. Additionally, the singular forms "a", "an", and "the" as used in this disclosure are intended to include the plural forms as well, unless the context clearly indicates otherwise.

The word "approximately" as used in this description in conjunction with a number or metric means within 5% of that number or metric.

It is contemplated that any feature of any aspect or embodiment discussed in this specification can be implemented or combined with any feature of any other aspect or embodiment discussed in this specification, except where those features have been explicitly described as mutually exclusive alternatives.

The invention claimed is:

1. A computer-implemented method of controlling a drilling operation, comprising:

determining that a differential pressure is in an oscillating state, comprising determining that the differential pressure has exceeded a differential pressure limit at least a preset number of times during a preset time window; and in response to determining that the differential pressure is in the oscillating state, decreasing a weight on bit setpoint so as to decrease the differential pressure, wherein determining that the differential pressure is in the oscillating state further comprises:

determining whether an average difference between a weight on bit and the weight on bit setpoint, since a first time the differential pressure exceeded the differential pressure limit, or since a beginning of the preset time window, is greater than a first threshold.

2. The method of claim 1, further comprising:

determining that at least the first time the differential pressure exceeded the differential pressure limit occurred outside the preset time window; and ignoring the at least the first time the differential pressure exceeded the differential pressure limit when determining that the differential pressure is in the oscillating state.

3. The method of claim 1, wherein determining that the differential pressure is in the oscillating state further comprises:

determining whether an average magnitude of the differential pressure sincethe first time the differential pressure exceeded the differential pressure limit, or since the beginning of the preset time window, is greater than a second threshold.

4. The method of claim 3, further comprising:

determining that the average magnitude of the differential pressure is not greater than the second threshold; and in response to determining that the average magnitude of the differential pressure is not greater than the second threshold, ignoring the first time the differential pressure exceeded the differential pressure limit when determining that the differential pressure is in the oscillating state.

5. The method of claim 1, wherein determining that the differential pressure is in the oscillating state further comprises:

determining whether an average magnitude of a weight on bit since the first time the differential pressure exceeded the differential pressure limit, or since the beginning of the preset time window, is greater than a third threshold.

6. The method of claim 1, further comprising:

determining that the average difference between the weight on bit and the weight on bit setpoint is not greater than first threshold; and in response to determining that the average difference between the weight on bit and the weight on bit setpoint is not greater than the first threshold, ignoring the first time the differential pressure exceeded the differential pressure limit when determining that the differential pressure is in the oscillating state.

7. A computer-readable medium having computer program code stored thereon and configured when executed by one or more processors to cause the one or more processors to perform a method for controlling a drilling operation, comprising:

determining that a differential pressure is in an oscillating state, comprising determining that the differential pressure has exceeded a differential pressure limit at least a preset number of times during a preset time window; and in response to determining that the differential pressure is in the oscillating state, decreasing a weight on bit setpoint so as to decrease the differential pressure, wherein determining that the differential pressure is in the oscillating state further comprises:

determining whether an average difference between a weight on bit and the weight on bit setpoint, since a first time the differential pressure exceeded the differential pressure limit, or since a beginning of the preset time window, is greater than a first threshold.

8. The computer-readable medium of claim 7, wherein the method further comprises:

determining that at least the first time the differential pressure exceeded the differential pressure limit occurred outside the preset time window; and ignoring the at least the first time the differential pressure exceeded the differential pressure limit when determining that the differential pressure is in the oscillating state.

9. The computer-readable medium of claim 7, wherein determining that the differential pressure is in the oscillating state further comprises:

determining whether an average magnitude of the differential pressure since the first time the differential pressure exceeded the differential pressure limit, or since the beginning of the preset time window, is greater than a second threshold.

10. The computer-readable medium of claim 9, wherein the method further comprises:

determining that the average magnitude of the differential pressure is not greater than the second threshold; and in response to determining that the average magnitude of the differential pressure is not greater than the second threshold, ignoring the first time the differential pressure exceeded the differential pressure limit when determining that the differential pressure is in the oscillating state.

11. The computer-readable medium of claim 7, wherein determining that the differential pressure is in the oscillating state further comprises:

determining whether an average magnitude of a weight on bit since the first time the differential pressure exceeded the differential pressure limit, or since the beginning of the preset time window, is greater than a third threshold.

12. The computer-readable medium of claim 11, wherein the method further comprises:

determining that the average magnitude of the weight on bit is not greater than the third threshold; and in response to determining that the average magnitude of the weight on bit is not greater than the third threshold, ignoring the first time the differential pressure exceeded the differential pressure limit when determining that the differential pressure is in the oscillating state.

13. The computer-readable medium of claim 7, wherein the method further comprises:

determining that the average difference between the weight on bit and the weight on bit setpoint is not greater than the first threshold; and in response to determining that the average difference between the weight on bit and the weight on bit setpoint is not greater than the first threshold, ignoring the first time the differential pressure exceeded the differential pressure limit when determining that the differential pressure is in the oscillating state.

14. A system comprising:

a drill string comprising a bottom hole assembly including a drill bit;

a drawworks operable to control a weight applied to the drill bit; and an oscillation detector comprising computer-readable memory and one or more processors, wherein the compute-readable memory comprises computer program code stored thereon and configured, when executed by the one or more processors, to cause the one or more processors to perform a method of controlling a drilling operation, comprising:

determining whether that a differential pressure is in an oscillating state, comprising determining whether the differential pressure has exceeded a differential pressure limit at least a preset number of times during a preset time window; and if the differential pressure is determined to be in the oscillating state, decreasing a weight on bit setpoint so as to decrease a weight applied to the drill bit, wherein determining whether the differential pressure is in the oscillating state further comprises:

determining whether an average difference between a weight on bit and the weight on bit setpoint, since a first time the differential pressure exceeded the differential pressure limit, or since a beginning of the preset time window, is greater than a first threshold; and if the average difference between the weight on bit and the weight on bit setpoint is determined to be greater than the first threshold, ignoring the first time the differential pressure exceeded the differential pressure limit when determining whether the differential pressure is in the oscillating state.

15. The system of claim 14, wherein the method further comprises:

determining whether at least the first time the differential pressure exceeded the differential pressure limit occurred outside the preset time window; and if the at least the first time the differential pressure exceeded the differential pressure limit is determined to have occurred outside the preset time window, ignoring the at least the first time the differential pressure exceeded the differential pressure limit when determining whether the differential pressure is in the oscillating state.

16. The system of claim 14, wherein determining whether the differential pressure is in the oscillating state further comprises:

determining whether an average magnitude of the differential pressure since the first time the differential pressure exceeded the differential pressure limit, or since the beginning of the preset time window, is greater than a second threshold; and if the average magnitude of the differential pressure is determined to not be greater than the second threshold, ignoring the first time the differential pressure exceeded the differential pressure limit when determining whether the differential pressure is in the oscillating state.

17. The system of claim 14, wherein determining whether the differential pressure is in the oscillating state further comprises:

determining whether an average magnitude of a weight on bit since the first time the differential pressure exceeded the differential pressure limit, or since the beginning of the preset time window, is greater than a third threshold; and if the average magnitude of the weight on bit is determined to not be greater than the third threshold, ignoring the first time the differential pressure exceeded the differential pressure limit when determining whether the differential pressure is in the oscillating state.

18. A computer-implemented method of controlling a drilling operation, comprising:

determining that a differential pressure is in an oscillating state, comprising determining that the differential pressure has exceeded a differential pressure limit at least a preset number of times during a preset time window; and in response to determining that the differential pressure is in the oscillating state, decreasing a weight on bit setpoint so as to decrease the differential pressure, wherein the method further comprises:

determining that at least the first time the differential pressure exceeded the differential pressure limit occurred outside the preset time window; and ignoring the at least the first time the differential pressure exceeded the differential pressure limit when determining that the differential pressure is in the oscillating state.

19. A computer-readable medium having computer program code stored thereon and configured when executed by one or more processors to cause the one or more processors to perform a method for controlling a drilling operation, comprising:

determining that a differential pressure is in an oscillating state, comprising determining that the differential pressure has exceeded a differential pressure limit at least a preset number of times during a preset time window; and in response to determining that the differential pressure is in the oscillating state, decreasing a weight on bit setpoint so as to decrease the differential pressure, wherein the method further comprises:

determining that at least the first time the differential pressure exceeded the differential pressure limit occurred outside the preset time window; and ignoring the at least the first time the differential pressure exceeded the differential pressure limit when determining that the differential pressure is in the oscillating state.

20. A system comprising:

a drill string comprising a bottom hole assembly including a drill bit;

a drawworks operable to control a weight applied to the drill bit; and an oscillation detector comprising computer-readable memory and one or more processors, wherein the compute-readable memory comprises computer program code stored thereon and configured, when executed by the one or more processors, to cause the one or more processors to perform a method of controlling a drilling operation, comprising:

determining whether that a differential pressure is in an oscillating state, comprising determining whether the differential pressure has exceeded a differential pressure limit at least a preset number of times during a preset time window; and if the differential pressure is determined to be in the oscillating state, decreasing a weight on bit setpoint so as to decrease a weight applied to the drill bit, wherein the method further comprises:

determining whether at least the first time the differential pressure exceeded the differential pressure limit occurred outside the preset time window; and if the at least the first time the differential pressure exceeded the differential pressure limit is determined to have occurred outside the preset time window, ignoring the at least the first time the differential pressure exceeded the differential pressure limit when determining whether the differential pressure is in the oscillating state.

* * * * *